US009187276B2

(12) United States Patent
Maeshima

(10) Patent No.: US 9,187,276 B2
(45) Date of Patent: Nov. 17, 2015

(54) RECORDING MATERIAL CONVEYANCE APPARATUS AND IMAGE FORMING APPARATUS

(71) Applicant: CANON KABUSHIKI KAISHA, Tokyo (JP)

(72) Inventor: Yoko Maeshima, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/647,269

(22) Filed: Oct. 8, 2012

(65) Prior Publication Data

US 2013/0094888 A1 Apr. 18, 2013

(30) Foreign Application Priority Data

Oct. 12, 2011 (JP) ..... 2011-225106

(51) Int. Cl.

| | |
|---|---|
| ***G03G 15/00*** | (2006.01) |
| ***B65H 5/06*** | (2006.01) |
| ***B41J 11/42*** | (2006.01) |
| ***B65H 7/08*** | (2006.01) |

(52) U.S. Cl.

CPC ..... *B65H 5/062* (2013.01); *B41J 11/42* (2013.01); *B65H 7/08* (2013.01); *G03G 15/6564* (2013.01); *B65H 2403/923* (2013.01); *B65H 2511/51* (2013.01); *B65H 2513/10* (2013.01); *B65H 2513/50* (2013.01); *B65H 2555/25* (2013.01); *B65H 2557/2644* (2013.01); *B65H 2701/1311* (2013.01)

(58) Field of Classification Search

CPC .. B65H 7/08; B65H 2555/25; B65H 2513/10; B65H 2557/2644; B65H 2701/1311; B65H 2403/50; G03G 15/6564

USPC ..... 399/389, 45, 388; 271/265.04, 3.13, 271/262

See application file for complete search history.

(56) References Cited

U.S. PATENT DOCUMENTS

| | | | | |
|---|---|---|---|---|
| 6,385,406 | B1 * | 5/2002 | Funamizu et al. | 399/16 |
| 2002/0106228 | A1 | 8/2002 | Asuwa | |
| 2003/0062671 | A1 | 4/2003 | Yasui | |
| 2003/0118360 | A1 * | 6/2003 | Joichi et al. | 399/45 |
| 2008/0217846 | A1 * | 9/2008 | Shibagaki et al. | 271/264 |
| 2008/0306626 | A1 * | 12/2008 | Elliot | 700/230 |

FOREIGN PATENT DOCUMENTS

| | | | |
|---|---|---|---|
| CN | 1403882 | A | 3/2003 |
| CN | 101354546 | A | 1/2009 |
| JP | H05-077407 | A | 3/1993 |
| JP | H08-020138 | A | 1/1996 |
| JP | 2003-039762 | A | 2/2003 |
| JP | 2004-088926 | A | 3/2004 |
| JP | 2008-094573 | A | 4/2008 |
| JP | 2009-204794 | A | 9/2009 |
| JP | 2010-066587 | A | 3/2010 |

* cited by examiner

*Primary Examiner* — Matthew G Marini

(74) *Attorney, Agent, or Firm* — Canon USA Inc. IP Division

(57) ABSTRACT

An image forming apparatus includes a conveyance unit configured to convey a recording material, a driving unit configured to drive the conveyance unit based on a manipulated variable corresponding to a deviation between a conveyance speed of the recording material and a target conveyance speed, and a control unit configured to change a control method for controlling the manipulated variable required to drive the driving unit according to a state in which the recording material is conveyed by the conveyance unit.

11 Claims, 15 Drawing Sheets

FIG.11

| 412 CONVEYANCE SEQUENCE PERIOD INFORMATION | 405a CONTROL SECTION | 405b CONTROL SECTION | 405c CONTROL SECTION | 405d CONTROL SECTION |
|---|---|---|---|---|
| 602 STARTUP PERIOD | TARGET RESPONSIVENESS PRIORITIZED | FIXED VALUE | × | × |
| 603 ACCELERATION/ DECELERATION PERIOD | TARGET RESPONSIVENESS PRIORITIZED | FIXED VALUE | FIXED VALUE | × |
| 604 TRANSFER PREPARATION PERIOD | DISTURBANCE SUPPRESSION PRIORITIZED | FIXED VALUE | × | CUTOFF FREQUENCY HIGH |
| 605 TRANSFER PERIOD | MODERATE RESPONSIVENESS | FIXED VALUE | × | CUTOFF FREQUENCY LOW |

RECORDING MATERIAL CONVEYANCE APPARATUS AND IMAGE FORMING APPARATUS

BACKGROUND OF THE INVENTION

1. Field of the Invention

The present invention relates to an image forming apparatus that controls a driving unit configured to drive a conveyance unit, which is configured to convey a recording material.

2. Description of the Related Art

A conventional image forming apparatus has the capability of increasing or decreasing the conveyance speed of each recording material to convey recording materials at optimum intervals in image forming processing. To convey a recording material to a transfer position at ideal timing, the acceleration/deceleration control includes detecting the recording material with a sensor disposed on a conveyance path. The acceleration/deceleration control further includes obtaining a difference between the detected arrival timing of the recording material and ideal arrival timing. The acceleration/deceleration control further includes increasing or decreasing the conveyance speed in such a way as to reduce unevenness, such as advanced/delayed pickup or slippage occurring during a conveyance operation, to convey the recording material to the transfer position at ideal timing.

In general, a driving source of a recording material conveyance unit is a stepping motor or a direct current (DC) motor. The stepping motor is desirably used in feed-forward control because the stepping motor can cause an angular movement in proportion to the number of pulses of an input signal. In other words, the stepping motor is excellent in speed and position controllability compared to a DC motor used in feedback control. From the reason described above, the stepping motor is desirably employable as the driving source of the conveyance unit. On the other hand, the DC motor is a recently employed driving source for a recording material conveyance unit because the conveyance speed tends to increase and the required torque of the driving source tends to increase. For example, a conventional method discussed in Japanese Patent Application Laid-Open No. 2004-88926 includes generating an ideal profile for a driving operation, when the driving operation is performed, based on a target position and predetermined parameters, in the control of a DC motor employed as a power source for a device driving a mechanism, and controlling the driving of the DC motor according to the generated profile.

As conventionally known, when a DC motor is employed as a driving source, it is feasible to obtain a large torque. However, in an image forming apparatus, an optimum control method for controlling the conveyance speed of a recording material is variable depending on each control period in the process of conveying the recording material. Therefore, if a DC motor or a comparable driving source requiring feedback control is employed to perform conveyance control with fixed control constants in any control period, it is unfeasible to perform optimum control according to a conveyance state of the recording material. It is difficult to accurately control the conveyance speed of the recording material.

SUMMARY OF THE INVENTION

The present invention is directed to a recording material conveyance apparatus that is capable of accurately controlling the conveyance speed of a recording material even in a case where a driving source is a DC motor or a comparable motor that requires feedback control.

According to an aspect of the present invention, an image forming apparatus includes a conveyance unit configured to convey a recording material, a driving unit configured to drive the conveyance unit based on a manipulated variable corresponding to a deviation between a conveyance speed of the recording material and a target conveyance speed, and a control unit configured to change a control method for controlling the manipulated variable required to drive the driving unit according to a state in which the recording material is conveyed by the conveyance unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 11 is a graph illustrating a relationship between conveyance sequence period information and control constant combination information and a relationship between the conveyance sequence period information and control unit combination information according to the first exemplary embodiment of the present invention.

DESCRIPTION OF THE EMBODIMENTS

Various exemplary embodiments, features, and aspects of the invention will be described in detail below with reference to the drawings.

Figure 1:
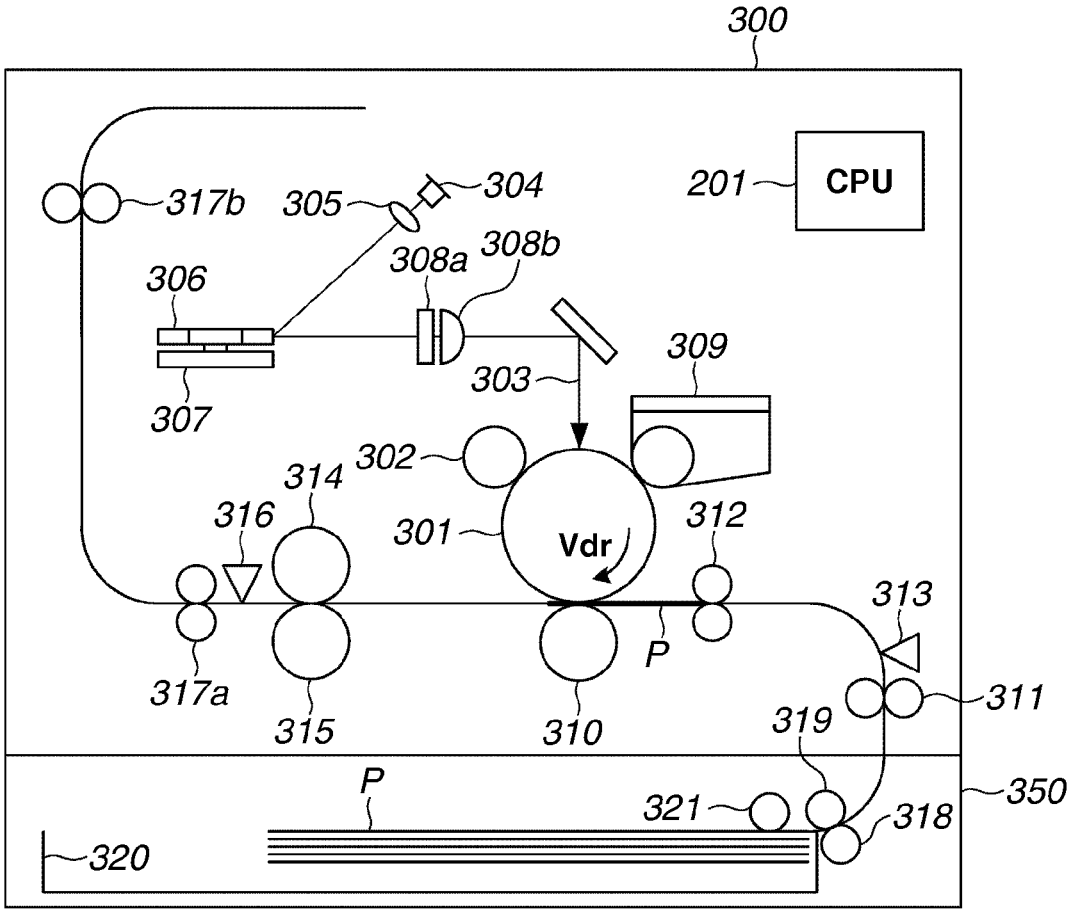
FIG. 1 illustrates a schematic configuration of an image forming apparatus according to a first exemplary embodiment of the present invention.

FIG. 1 illustrates a schematic configuration of an image forming apparatus according to a first exemplary embodiment. An example of the image forming apparatus described in the present exemplary embodiment is an electrographic monochrome printer. However, the image forming apparatus according to the present invention is not limited to the monochrome printer and can be a color printer or an inkjet printer.

In the image forming apparatus 300 illustrated in FIG. 1, a central processing unit (CPU) 201 can control sensors and motors and can control various operations to be performed by the image forming apparatus 300. A photosensitive drum 301 is a member capable of carrying an electrostatic latent image. A charging roller 302, which is capable of uniformly charging the surface of the photosensitive drum 301, is provided at an upper portion around the photosensitive drum 301. The charging roller 302 has a surface that is brought into contact with the surface of the photosensitive drum 301. The charging roller 302 can charge the surface of the photosensitive drum 301. A light-emitting unit can irradiate the charged surface of the photosensitive drum 301 with a light beam 303. The light-emitting unit includes the following members. A semiconductor laser 304 can emit the light beam 303. A collimator lens 305 can polarize the semiconductor laser 304 into parallel light. A polygonal mirror 306 can scan the surface of the photosensitive drum 301 with the light beam 303. An optical lens 308*a* can adjust the light beam 303 in such a way as to form a spot on the surface of the photosensitive drum 301. A cylindrical lens 308*b* can form a linear image of the parallel light on the photosensitive drum 301. A scanner motor 307 can drive the polygonal mirror 306 in such a way as to rotate at a constant speed.

An electrostatic latent image can be formed on the surface of the photosensitive drum 301 by irradiating the surface with the light beam 303 based on image data of the image to be formed. The circumferential speed of the photosensitive drum 301 in this case is referred to as an image formation speed Vdr. The electrostatic latent image can be developed into a toner image by a developing device 309, which is brought into contact with the photosensitive drum 301 on the downstream side of an irradiation position of the light beam 303 in the rotational direction of the photosensitive drum 301. The toner image can be transferred onto a recording material P (e.g., paper) by a transfer roller 310, which is disposed in a confronting relationship with the photosensitive drum 301.

The recording material P is stored in a recording material cassette 320 that is provided in a paper feeding unit 350 positioned on the upstream side of the photosensitive drum 301 at the lower side of the apparatus body. Further, the recording material P can be stored in a manual insertion tray (not illustrated). A paper feeding roller 321 is disposed at an edge portion of the recording material cassette 320. The paper feeding roller 321 can move (cause a swing motion) in the up-and-down direction while it rotates around its rotational axis. The paper feeding roller 321 can perform a pickup operation for the recording material P stored in the recording material cassette 320. A feed roller 319 and a retard roller 318 cooperatively feed only one (the uppermost) sheet of the recording material P to a conveyance path.

A pair of registration rollers 312 is disposed on a conveyance path extending from a pair of conveyance rollers 311 to the transfer roller 310. The registration rollers 312 can correct the skew of the recording material P and can synchronize image forming timing of the photosensitive drum 301 with conveyance timing of the recording material P. The registration rollers 312 can feed the recording material P to a transfer position, which is formed by the photosensitive drum 301 and the transfer roller 310, at predetermined timing. A registration sensor 313, i.e., a registration paper presence detecting sensor, is disposed between the registration rollers 312 and the conveyance rollers 311. The registration sensor 313 can detect the recording material P.

The toner image formed on the photosensitive drum 301 can be transferred to the recording material P at the transfer position. Then, the recording material P can be conveyed to a fixing device disposed on the downstream side of the photosensitive drum 301. The fixing device includes a fixing roller 314 and a pressing roller 315 that are disposed in a mutually press-contacting state. The fixing roller 314 includes a fixing heater (not illustrated) provided in its body. The fixing heater can heat the recording material P on which the toner image has been transferred when the recording material P is conveyed to a press-contact portion between the fixing roller 314 and the pressing roller 315. As a result, the toner image can be fixed on the recording material P. A discharge sheet presence detection sensor 316, which is capable of confirming the recording material P conveyed from the press-contact portion, is disposed on the downstream side of the fixing device. A pair of discharge rollers 317*a* and a pair of discharge rollers 317*b* are disposed on the downstream side of the discharge sheet presence detection sensor 316. The discharge rollers 317*a* and 317*b* can cooperatively discharge the fixed recording material P to a discharge tray.

Figure 2:
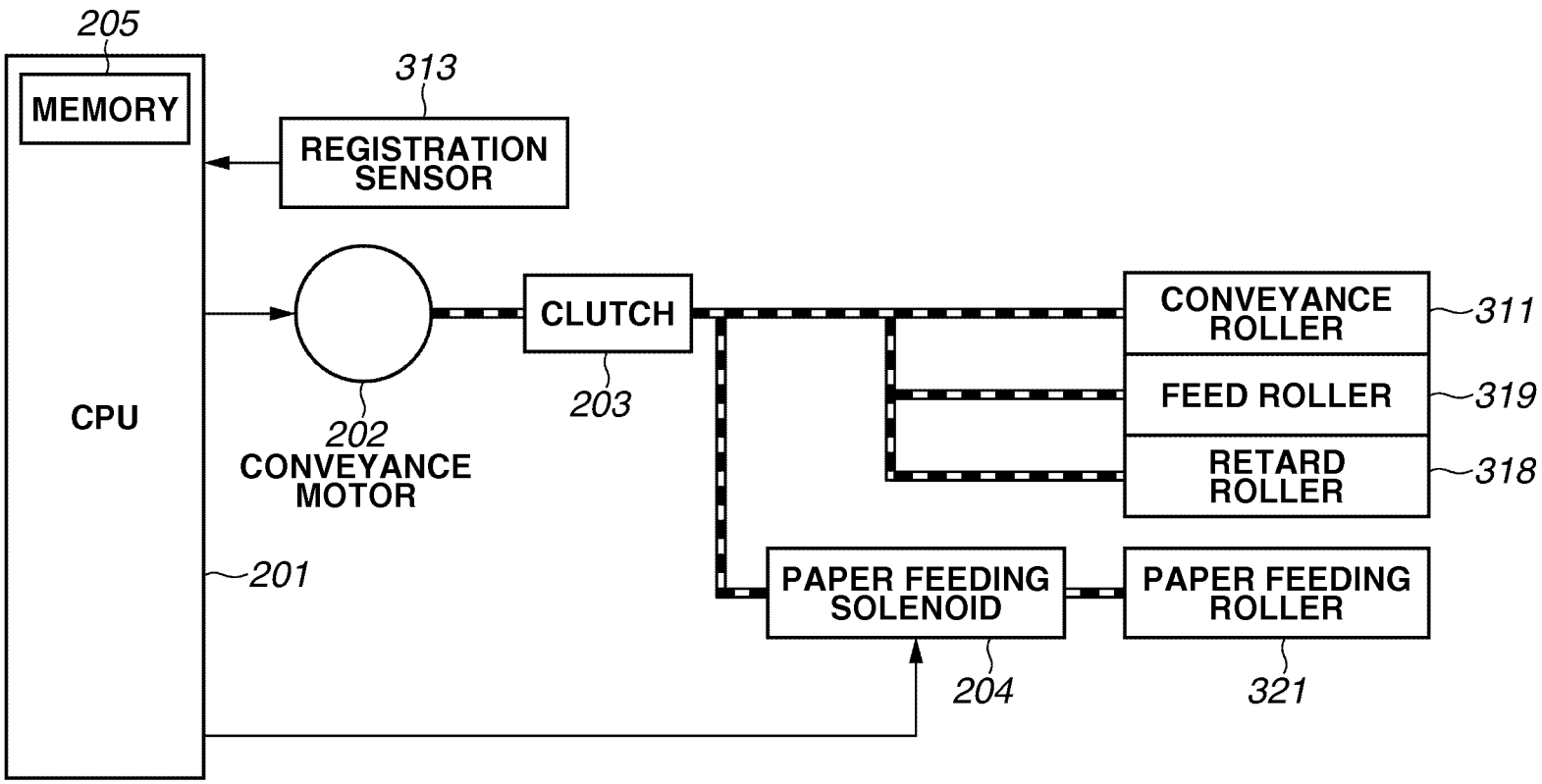
FIG. 2 is a block diagram illustrating a hardware configuration of the image forming apparatus according to the first exemplary embodiment of the present invention.

FIG. 2 is a block diagram illustrating a hardware configuration of the image forming apparatus 300. The central processing unit (CPU) 201 can control various operations to be performed by the image forming apparatus 300. A conveyance motor 202 is a driving source that can drive the image forming apparatus 300. The conveyance motor 202 is equipped with a sensor serving as a motor position detection unit configured to detect the present position of the motor. A clutch 203 can selectively transmit the driving force of the conveyance motor 202. A paper feeding solenoid 204 can drive the paper feeding roller 321 at a paper feeding port. A memory 205 stores programs and data that are required to execute the whole or a part of processing to be performed by the CPU 201. The conveyance rollers 311 can convey the recording material P when it is fed from the recording material cassette 320. The registration sensor 313 can detect the recording material P when the recording material P passes through a predetermined position. The retard roller 318 and the feed roller 319 can cooperatively feed the recording material P without causing any double feed. The paper feeding roller 321 can pick up the recording material P.

The CPU 201 is connected to the memory 205 via a bus (not illustrated). The CPU 201 controls operations to be performed by the image forming apparatus 300 with reference to programs and data stored in the memory 205. In the present exemplary embodiment, the memory 205 is provided in the CPU 201. However, the memory 205 can be positioned outside the CPU 201.

Next, paper feed and conveyance control that can be performed by the image forming apparatus 300 is described below. In response to a print instruction received from a controller (not illustrated), the CPU 201 performs preparation (e.g., starts driving the conveyance motor 202) to form an image. The CPU 201 brings the clutch 203 into an engaged state when a predetermined time has elapsed after the driving of the conveyance motor 202 is started. Further, the CPU 201 starts driving the conveyance rollers 311, the feed roller 319, and the retard roller 318. Subsequently, the CPU 201 activates the paper feeding solenoid 204 to drive the paper feeding roller 321. The paper feeding roller 321 picks the recording material P from the recording material cassette 320. More specifically, only one (the uppermost) sheet of the recording material P can be separated from the rest of the recording material P in the recording material cassette 320 by the feed roller 319 and the retard roller 318 that are cooperatively rotating in opposite directions. The picked up paper can be conveyed by the conveyance rollers 311.

When the registration sensor 313 detects a leading edge of the recording material P, the CPU 201 calculates a deviation amount between the position of an image formed on the photosensitive drum 301 and the position of the currently conveyed recording material P. Then, to correct the position of the recording material P in synchronization with the position of the image formed on the photosensitive drum 301, the conveyance rollers 311 perform an acceleration/deceleration operation taking a positional correction amount into consideration to correct the deviation amount. Subsequently, the conveyance rollers 311 convey the recording material P to the transfer position where the photosensitive drum 301 faces the transfer roller 310.

Next, the necessity of performing the acceleration/deceleration control for the recording material P is described below. When the feeding of sheets from the recording material cassette 320 is performed, the position of the leading edge of the recording material P at the conveyance start timing is variable depending on a state of the recording material P that is separated by the feed roller 319 and the retard roller 318. For example, immediately after sheets (recording material) are stored in the recording material cassette 320, the first sheet is not pulled forward together with a preceding sheet because there is not any preceding sheet. Therefore, the leading edge of the first sheet is substantially positioned in the recording material cassette 320. On the other hand, the second sheet of the recording material P is somewhat pulled forward together with the first sheet in accordance with the conveyance (feeding) of the first sheet. Thus, the second sheet of the recording material P is separated together with the first sheet by the retard roller 318 and the feed roller 319. Accordingly, the leading edge of the second sheet is substantially positioned in the vicinity of the retard roller 318. Therefore, even if the conveyance of each recording material P is performed at the same speed, the recording material P will differently reach the transfer position (i.e., the contact point between the photosensitive drum 301 and the transfer roller 310). The CPU 201 acquires elapsed time T1 from the registration sensor 313. The elapsed time T1 indicates the timing the leading edge of the recording material P has reached the predetermined position while the recording material P is conveyed by the conveyance rollers 311.

Figure 3:
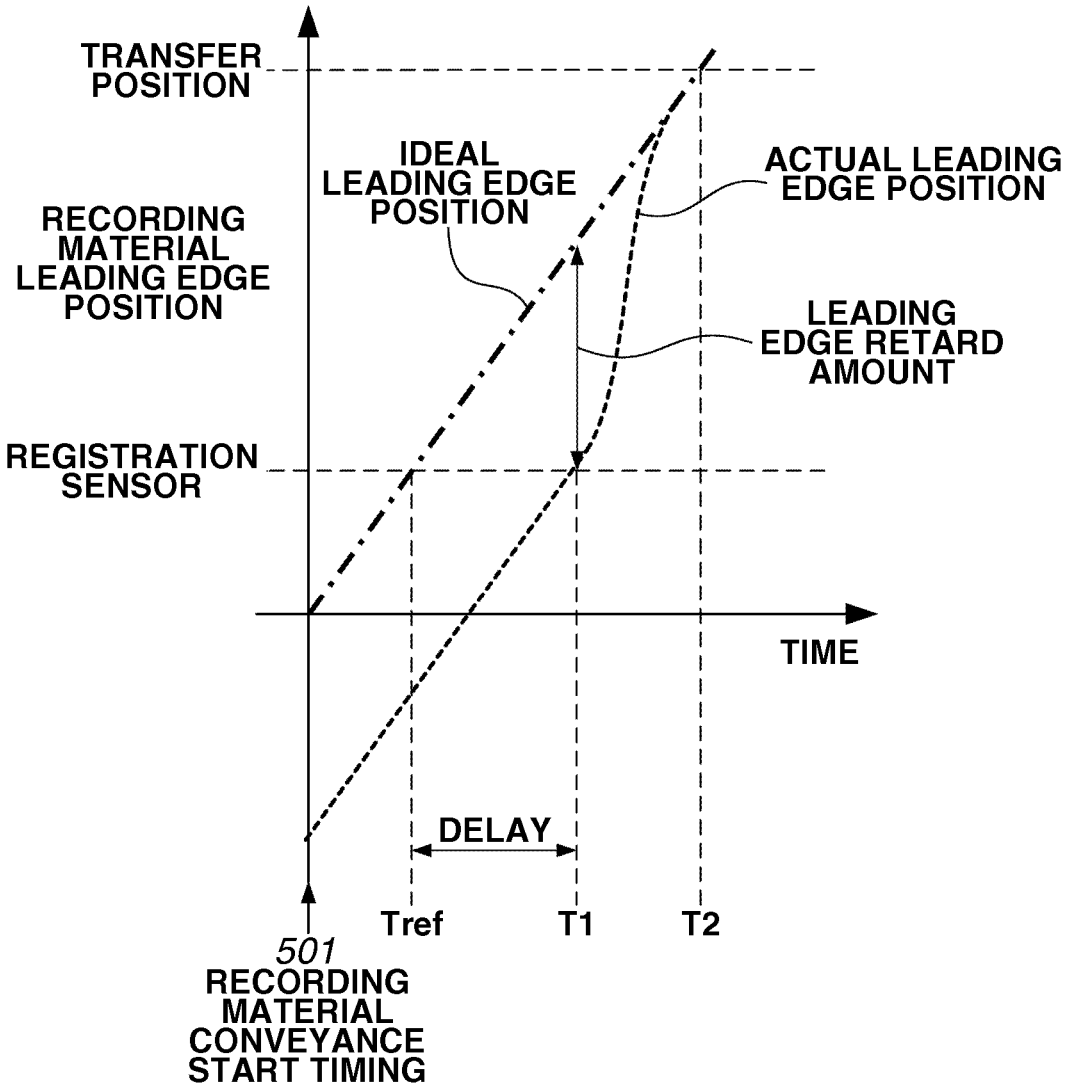
FIG. 3 illustrates a relationship between a recording material conveyed across a registration sensor and elapsed time.

FIG. 3 illustrates example control that can be performed in a case where the elapsed time T1 (i.e., the timing the recording material P has arrived at the registration sensor 313) is later than ideal time Tref. In FIG. 3, the abscissa axis represents the elapsed time and the ordinate axis represents the leading edge position of the recording material P. The conveyance of the recording material P starts at recording material conveyance start timing 501. In FIG. 3, a dotted line indicates the trajectory of the actual leading edge position of the recording material P before the recording material P reaches the registration sensor 313. An alternate long and short dash line indicates the trajectory of the ideal leading edge position of the recording material P. A difference between the elapsed time T1 (i.e., the timing the actual leading edge of the recording material P has reached the registration sensor 313) and the ideal time Tref represents a time delay with respect to the leading edge of the recording material P. A leading edge retard amount of the recording material P can be calculated based on the conveyance speed at this moment. It is necessary to increase the conveyance speed of the recording material P in such a way as to eliminate the retard amount and gradually equalize the actual leading edge position of the recording material P with the ideal leading edge position of the recording material P, and cause the recording material P to finally reach the transfer position at ideal elapsed time T2.

Further, although not illustrated in FIG. 3, if the elapsed time T1 (i.e., the timing the recording material P has arrived at the registration sensor 313) is earlier than the ideal time Tref, the control is performed in the same manner as the above-described case. In this case, the difference between the elapsed time T1 (i.e., the timing the actual leading edge position of the recording material P has reached the registration sensor 313) and the ideal time Tref represents a time advance with respect to the leading edge of the recording material P. A leading edge advance amount of the recording material P can be calculated based on the conveyance speed at this moment. It is necessary to reduce the conveyance speed of the recording material P in such a way as to eliminate the advance amount and gradually equalize the actual leading edge position of the recording material P with the ideal leading edge position of the recording material P, and cause the recording material P to finally reach the transfer position at ideal elapsed time T2. As described above, the actual leading edge position of the recording material is advanced or retarded relative to the ideal leading edge position of the recording material. In the following description, it is presumed that the leading edge position of the recording material is retarded.

Figure 4:
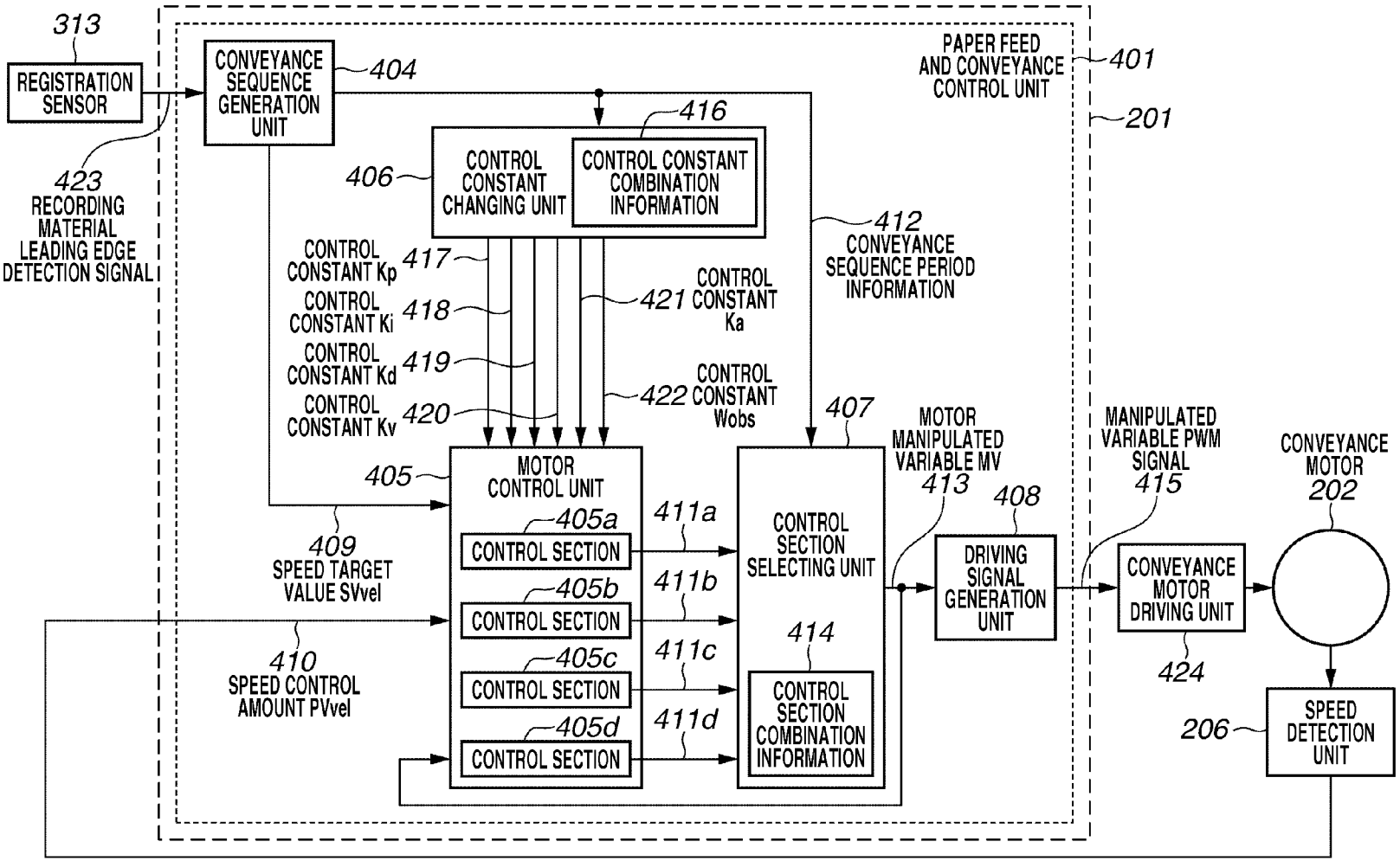
FIG. 4 is a functional block diagram illustrating a paper feed and conveyance control unit of a central processing unit (CPU) according to the first exemplary embodiment of the present invention.
Figure 5:
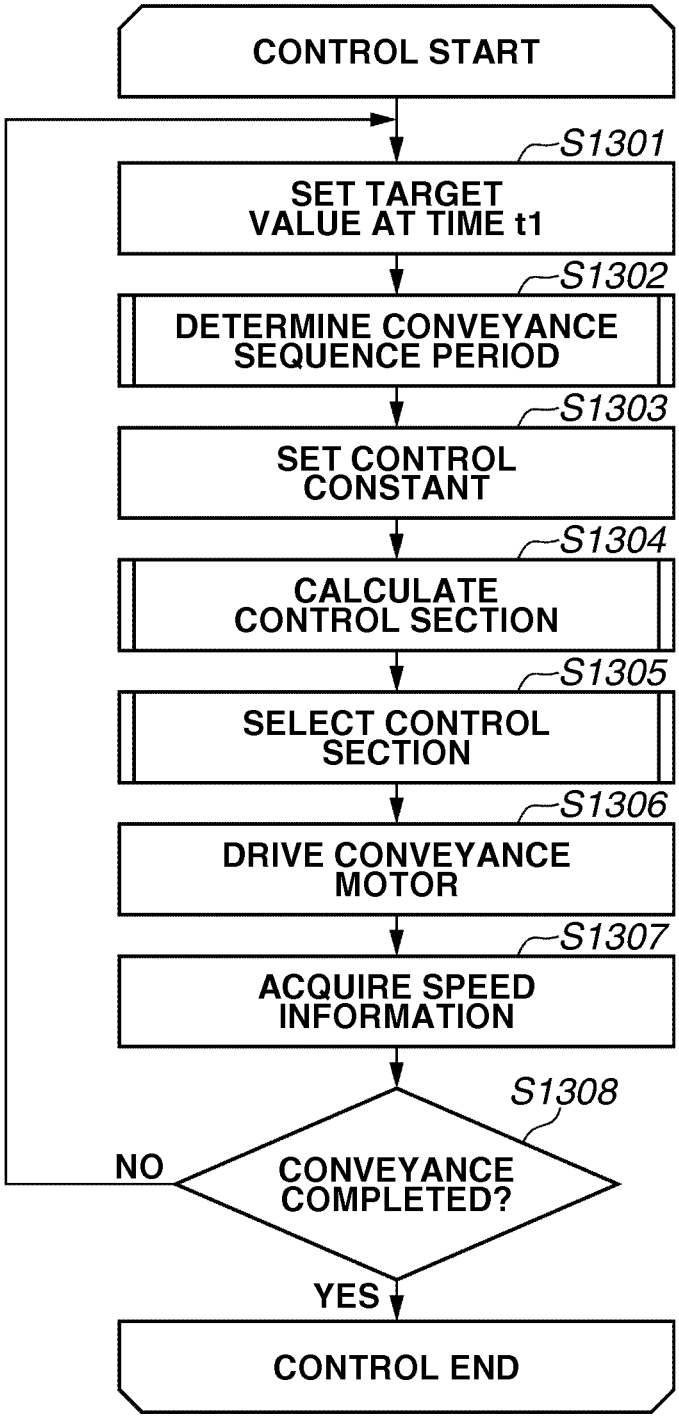
FIG. 5 is a flowchart schematically illustrating an operation that can be performed by the CPU according to the first exemplary embodiment of the present invention.

An example operation that can be performed by the CPU 201 is schematically described with reference to FIG. 4 and FIG. 5. FIG. 4 is a functional block diagram schematically illustrating a paper feed and conveyance control unit 401 of the CPU 201. FIG. 5 is a flowchart schematically illustrating an operation that can be performed by the CPU 201. Hereinafter, the operation to be performed by the CPU 201 is described below with reference to the block diagram illustrated in FIG. 4 and the flowchart illustrated in FIG. 5.

The paper feed and conveyance control unit 401 can receive input signals, such as a speed control amount PVvel 410 and a recording material leading edge detection signal 423. The paper feed and conveyance control unit 401 can output an output signal, such as a manipulated variable PWM signal 415. The paper feed and conveyance control unit 401 includes a conveyance sequence generation unit 404, a motor control unit 405, a control constant changing unit 406, a control section selecting unit 407, and a driving signal generation unit 408. In step S1301, the conveyance sequence generation unit 404 transmits a speed target value SVvel 409 to the motor control unit 405.

The speed target value SVvel 409 is a target angular speed of the conveyance motor 202. If the registration sensor 313 detects the leading edge of the recording material P, the registration sensor 313 sends the recording material leading edge detection signal 423 to the conveyance sequence generation unit 404. Instep S1302, the conveyance sequence generation unit 404 calculates the deviation amount between the position of an image already formed on the photosensitive drum 301 and the position of the currently conveyed recording material P based on the recording material leading edge detection signal 423. Then, to correct the position of the recording material P in synchronization with the position of the image formed on the photosensitive drum 301, the conveyance sequence generation unit 404 increases or decreases the speed target value SVvel 409. Further, the conveyance sequence generation unit 404 transmits conveyance sequence period information 412 to the control constant changing unit 406 and the control section selecting unit 407.

In step S1303, the control constant changing unit 406 transmits control constants 417 to 422 to the motor control unit 405. The control constant changing unit 406 changes the control constants to be supplied to the motor control unit 405 based on the conveyance sequence period information 412. The control constant changing unit 406 stores control constant combination information 416 that indicates a relationship between the conveyance sequence period information 412 and the control constants to be set. The conveyance sequence period information 412 and the control constants to be set are described in detail below. The motor control unit 405 includes a plurality of control sections 405*a* to 405*d*. The total number of the control sections that constitute the motor control unit 405 is not limited to the illustrated example. Namely, the motor control unit 405 can include an appropriate number of control sections. In step S1304, respective control sections 405*a* to 405*d* of the motor control unit 405 perform calculation processing based on the speed target value SVvel 409, the speed control amount PVvel 410, and a motor manipulated variable MV 413. The control sections 405*a* to 405*d* output calculated manipulated variables 411*a* to 411*d*, respectively. The control sections 405*a* to 405*d* are described in detail below.

In step S1305, the control section selecting unit 407 calculates the motor manipulated variable MV 413. The control section selecting unit 407 selects a combination of the control sections 405*a* to 405*d* based on the conveyance sequence period information 412. The control section selecting unit 407 calculates the motor manipulated variable MV 413 by adding only the manipulated variables corresponding to the selected combination of the control sections 405*a* to 405*d* (i.e., a part of the whole of the input manipulated variables 411*a* to 411*d*). In this case, it is desired that the control section selecting unit 407 performs weighting processing on the motor manipulated variable MV 413. For example, the control section selecting unit 407 can be configured to multiply the motor manipulated variable MV 413 by 0.9 before inputting the motor manipulated variable MV 413 to the driving signal generation unit 408. The control section selecting unit 407 includes control section combination information 414 that indicates the relationship between the conveyance sequence period information 412 and the control sections 405*a* to 405*d* to be selected. The relationship between the conveyance sequence period information 412 and the control sections 405*a* to 405*d* to be selected is described in detail below.

Figure 6:
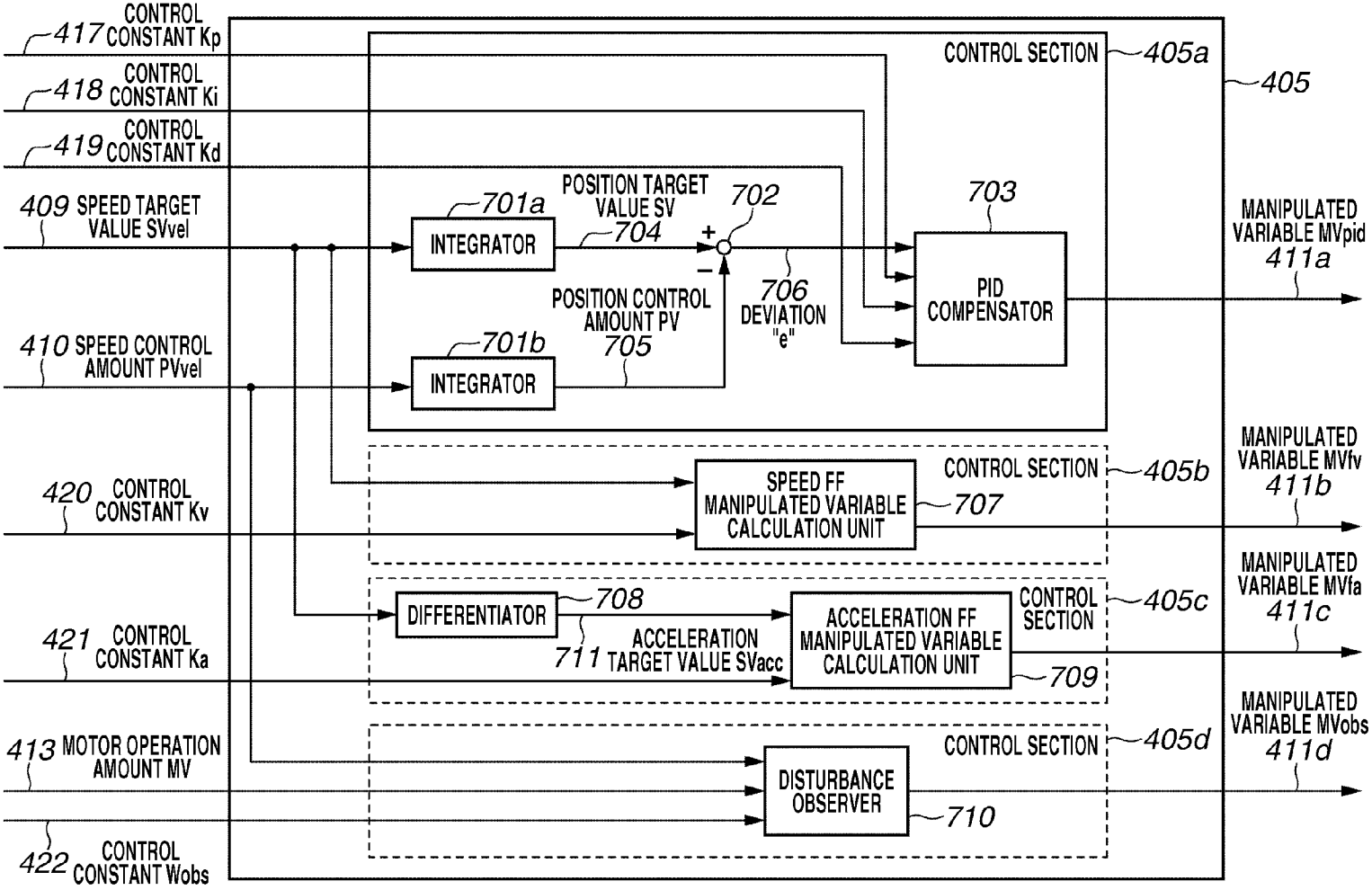
FIG. 6 is a functional block diagram illustrating a motor control unit according to the first exemplary embodiment of the present invention.
Figure 7:
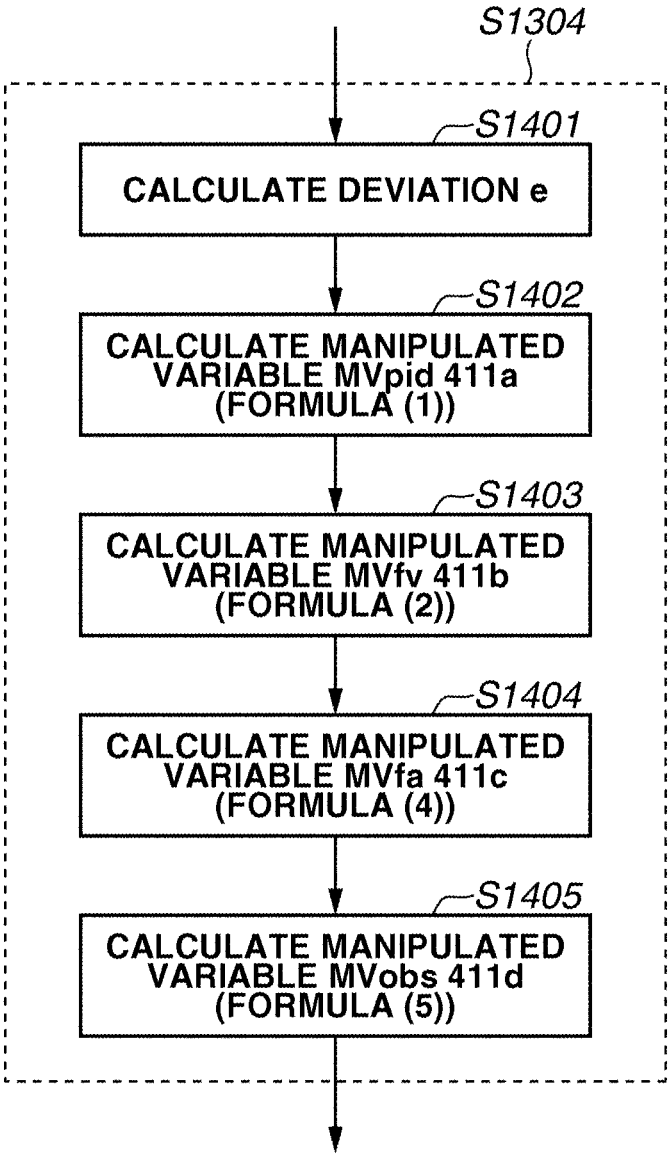
FIG. 7 is a flowchart schematically illustrating an operation that can be performed by the motor control unit according to the first exemplary embodiment of the present invention.

In step S1306, the driving signal generation unit 408 generates the manipulated variable PWM signal 415 having an on-duty width based on the motor manipulated variable MV 413 (i.e., the input signal). A conveyance motor driving unit 424 supplies a driving voltage to the conveyance motor 202 based on the manipulated variable PWM signal 415. The conveyance motor 202 can be driven when the driving voltage is supplied from the conveyance motor driving unit 424. In step S1307, a speed detection unit 206 detects the angular speed of the conveyance motor 202 and supplies the detected angular speed, as the speed control amount PVvel 410, to the motor control unit 405. Then, in step S1308, the CPU 201 determines whether the conveyance processing has been completed. If the conveyance processing is not yet completed (NO in step S1308), the operation returns to step S1301. If the conveyance processing has been completed (YES in step S1308), the CPU 201 terminates the control. An example operation that can be performed by the motor control unit 405 is schematically described below with reference to FIGS. 6 and 7. The motor control unit 405 includes a plurality of control sections 405*a* to 405*d*. FIG. 6 is a functional block diagram schematically illustrating the motor control unit 405. FIG. 7 is a flowchart schematically illustrating an operation that can be performed by the motor control unit 405. An example operation that can be performed by the motor control unit 405 is described with reference to the block diagram illustrated in FIG. 6 and the flowchart illustrated in FIG. 7.

The control section 405*a* can receive the speed target value SVvel 409, the speed control amount PVvel 410, control constant Kp 417, control constant Ki 418, and control constant Kd 419. The control section 405*a* can output the manipulated variable MVpid 411*a*. The control section 405*a* includes an integrator 701*a*, an integrator 701*b*, a positional deviation calculation unit 702, and a PID compensator 703. The integrator 701*a* can calculate a position target value SV 704 by integrating the speed target value SVvel 409. The integrator 701*b* can calculate a position control amount PV 705 by integrating the speed control amount PVvel 410. In step S1401, the positional deviation calculation unit 702 calculates a deviation "e" 706 between the position target value SV 704 and the position control amount PV 705. The PID compensator 703 can perform position feedback control for the conveyance motor 202. In the present exemplary embodiment, the "position" represents a cumulative phase angle of the conveyance motor 202, which is accumulated since the conveyance motor 202 is driven in response to the print instruction. In step S1402, the motor control unit 405 calculates the manipulated variable MVpid 411*a* (i.e., the output of the PID compensator 703) according to the following formula (1), in which Kp, Ki, and Kd represent control constants and "s" represents the Laplace operator.

$$MV\,pid = \left(Kp + \frac{Ki}{s} + Kd \times s\right) \times E \tag{1}$$

The control section 405*a* is a position feedback control unit, which can realize follow-up control to follow the position target value SV 704, which is variable depending on elapsed time in the present exemplary embodiment. Further, the control section 405*a* can switch from control highly responsive to the target value to control capable of highly suppressing the disturbance or to control indicating moderate responsiveness by selectively inputting the control constant Kp 417, the control constant Ki 418, and the control constant Kd 419. Each of the control highly responsive to the target value, the control capable of highly suppressing the disturbance, and the control indicating moderate responsiveness is described in detail below.

In the present exemplary embodiment, target value responsiveness is the responsiveness of the position control amount PV 705 that is variable depending on a change in the position target value SV 704. Accordingly, when the control highly responsive to the target value is selected, the position control amount PV 705 can promptly converge on the position target value SV 704 without causing any large overshoot when the position control amount PV 705 follows the position target value SV 704. On the other hand, disturbance suppressibility is the responsiveness of the position control amount PV 705 relative to a disturbance added to the conveyance motor 202 (i.e., a control target). Accordingly, when the control capable of highly suppressing the disturbance is selected, the deviation "e" caused when a disturbance is added to the conveyance motor 202 is small, and the position control amount PV 705 can promptly converge on the position target value SV 704.

In general, if the control capable of highly suppressing the disturbances is selected, the target value responsiveness has a tendency that it takes a long time to converge on the position target value SV 704 while causing a large overshoot, compared to the control highly responsive to the target value. Further, if the control highly responsive to the target values is selected, the disturbance suppressibility has a tendency that the deviation "e" caused when a disturbance is added to the conveyance motor 202 is large and it takes a long time to converge on the position target value SV 704, compared to the control capable of highly suppressing the disturbance. Further, if the control indicating moderate responsiveness is selected, the overshoot becomes smaller compared to that in the control highly responsive to the target value. In this case, in general, there is a tendency that it takes a long time to converge on the position target value SV 704, compared to the control highly responsive to the target value.

The control section 405*b* can receive the speed target value SVvel 409 and the control constant Kv 420 and can output the manipulated variable MVfv 411*b*. The control section 405*b* includes a speed feed-forward manipulated variable calculation unit 707 (hereinafter, "feed-forward" may be referred to as FF). The speed FF manipulated variable calculation unit 707 can multiply the speed target value SVvel 409 by an induced voltage constant Ke of the conveyance motor 202. Further, the speed FF manipulated variable calculation unit 707 can output the multiplied result (i.e., the value multiplied by the control constant Kv 420) to the manipulated variable MVfv 411*b*. The value of the induced voltage constant Ke is held in the motor control unit 405. In the present exemplary embodiment, the control constant Kv 420 and the induced voltage constant Ke are fixed values, although the constants Kv and Ke can be changed to adjust the manipulated variable MVfv 411*b*. The manipulated variable MVfv 411*b* can be obtained by multiplying a reverse voltage, which is generated when the conveyance motor 202 rotates at the speed target value SVvel 409, by the control constant Kv 420 (i.e., the gain adjustment constant). More specifically, the reverse voltage of the conveyance motor 202 can be predicted and compensated based on the manipulated variable MVfv 411*b*. In step S1403, the motor control unit 405*b* calculates the manipulated variable MVfv 411*b* according to the following formula (2).

$$MVfv = Kv \times Ke \times SVvel \tag{2}$$

The control section 405*b* is a feed-forward control unit, which is configured to reduce the deviation "e" 706 between the position target value SV 704 and the position control amount PV 705 by estimating a reverse voltage generated in the conveyance motor 202 and applying the estimated reverse voltage to the conveyance motor 202. The manipulated variable MVfv 411*b* is usable to enhance the target value responsiveness.

The control section 405*c* can receive the speed target value SVvel 409 and control constant Ka 421 and can output the manipulated variable MVfa 411*c*. The control section 405*c* includes a differentiator 708 and an acceleration FF manipulated variable calculation unit 709. The differentiator 708 can differentiate the speed target value SVvel 409 and can calculate an acceleration target value SVacc 711. The acceleration FF manipulated variable calculation unit 709 can calculate a voltage value that is required to cause the conveyance motor 202 to perform an acceleration or deceleration operation according to the acceleration target value SVacc 711 based on a conveyance motor approximate model described below. Further, the acceleration FF manipulated variable calculation unit 709 can multiply the control constant Ka 421 by the calculation result and can output an obtained value as the manipulated variable MVfa 411*c*. In the present exemplary embodiment, the control constant Ka 421 is a fixed value, although the control constant Ka 421 can be changed to adjust the gain of the manipulated variable MVfa 411*c*.

The following formula (3) is a conveyance motor approximate model P(s) that represents an approximate model transfer function of the conveyance motor 202, in which the input is the voltage and the output is the angular speed. In the present exemplary embodiment, Kt represents a torque constant of the conveyance motor 202 and L represents an internal inductance of the conveyance motor 202. Further, R represents a winding resistance of the conveyance motor 202 and J represents an inertia moment of the conveyance motor 202. The Kt, L, R, and J values are prepared beforehand in the control section 405*c*.

$$P(s) = \frac{Kt}{L \cdot s + R} \times \frac{1}{J \cdot s} \tag{3}$$

In step S1404, the motor control unit 405*c* calculates the manipulated variable MVfa 411*c* based on the conveyance motor approximate model P(s) according to the following formula (4).

$$\begin{aligned} MVfa &= Ka \times \frac{SVvel \times s}{P(s)} \\ &= Ka \times \frac{(L \times s + R) \times J \times s}{Kt} \times SVacc \end{aligned} \tag{4}$$

In the present exemplary embodiment, the motor control unit 405*c* can predict a voltage value required to cause the conveyance motor 202 to perform an acceleration or deceleration operation according to the acceleration target value SVacc 711. Then, the motor control unit 405*c* can apply the predicted voltage value to the conveyance motor 202 to reduce the deviation "e" 706 that may be generated between the position target value SV 704 and the position control amount PV 705. The manipulated variable MVfa 411*c* obtained by the acceleration feed-forward control unit can be used to enhance the target value responsiveness.

The control section 405*d* can receive the motor manipulated variable MV 413, the speed control amount PVvel 410, and the control constant Wobs 422. The control section 405*d* can output the manipulated variable MVobs 411*d*. The control section 405*d* includes a disturbance observer 710 that can perform a disturbance suppression control. The disturbance observer 710 can predict a disturbance torque applied to the conveyance motor based on the motor manipulated variable MV 413 and the speed control amount PVvel 410, and can calculate a voltage required to cancel the predicted disturbance torque. Then, the disturbance observer 710 can output the manipulated variable MVobs 411*d* that represents the voltage required to cancel the predicted disturbance torque. In the present exemplary embodiment, the main disturbance torque is a load torque. In step S1405, the control section 405*d* calculates the manipulated variable MVobs 411*d* based on the conveyance motor approximate model P(s) according to the following formula (5).

$$MVobs = \left(\frac{Kt}{L\times s+R}\times MV - J\times s\times PVvel\right)\times\frac{Wobs}{s+Wobs}\times\frac{1}{Kt} = \frac{Wobs}{s+Wobs}\times\frac{1}{L\times s+R}\times MV - \frac{Wobs}{1+\frac{Wobs}{s}}\times\frac{J}{Kt}\times PVvel \quad (5)$$

The control section 405*d* can predict and compensate a disturbance torque added to the conveyance motor 202. The manipulated variable MVobs 411*d* is usable to enhance the disturbance suppressibility. Further, by changing the control constant Wobs 422, it is feasible to change the cutoff frequency of the disturbance to be suppressed and selectively perform cutoff frequency increasing control and cutoff frequency decreasing control. As described above, when the disturbance torque is predicted and compensated by the disturbance observer 710, it is feasible to reduce the deviation "e" in the feedback control. Accordingly, the time required for the feedback control can be reduced.

Figure 8:
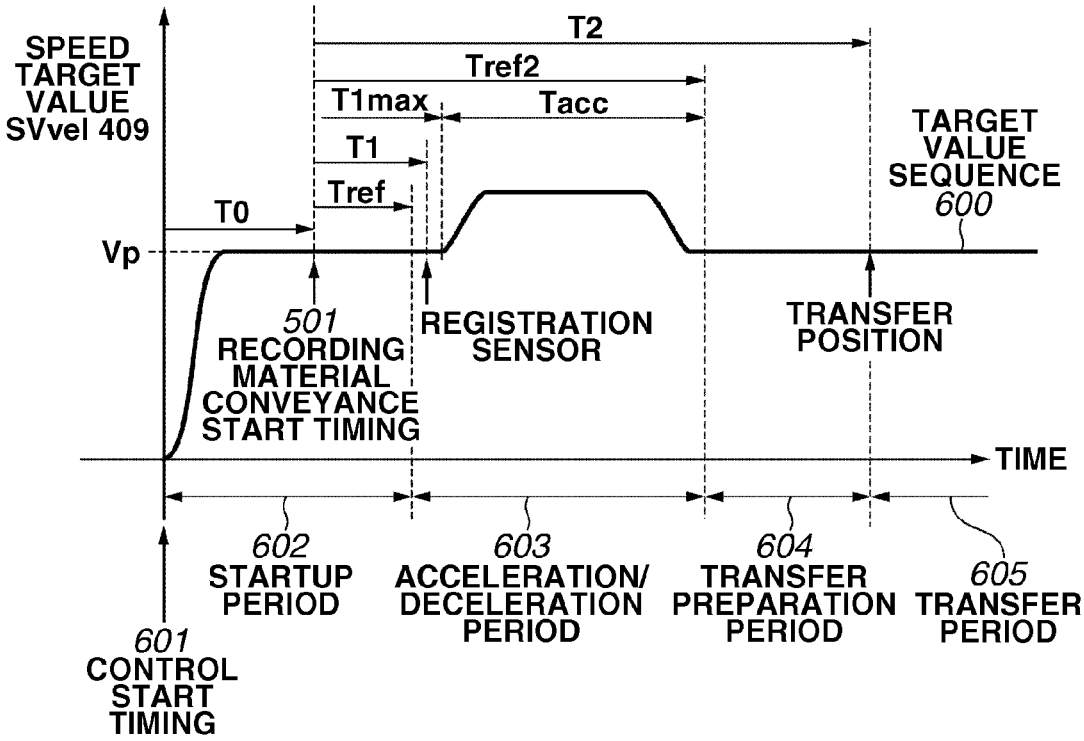
FIG. 8 is a timing chart illustrating a conveyance state of a recording material.
Figure 9:
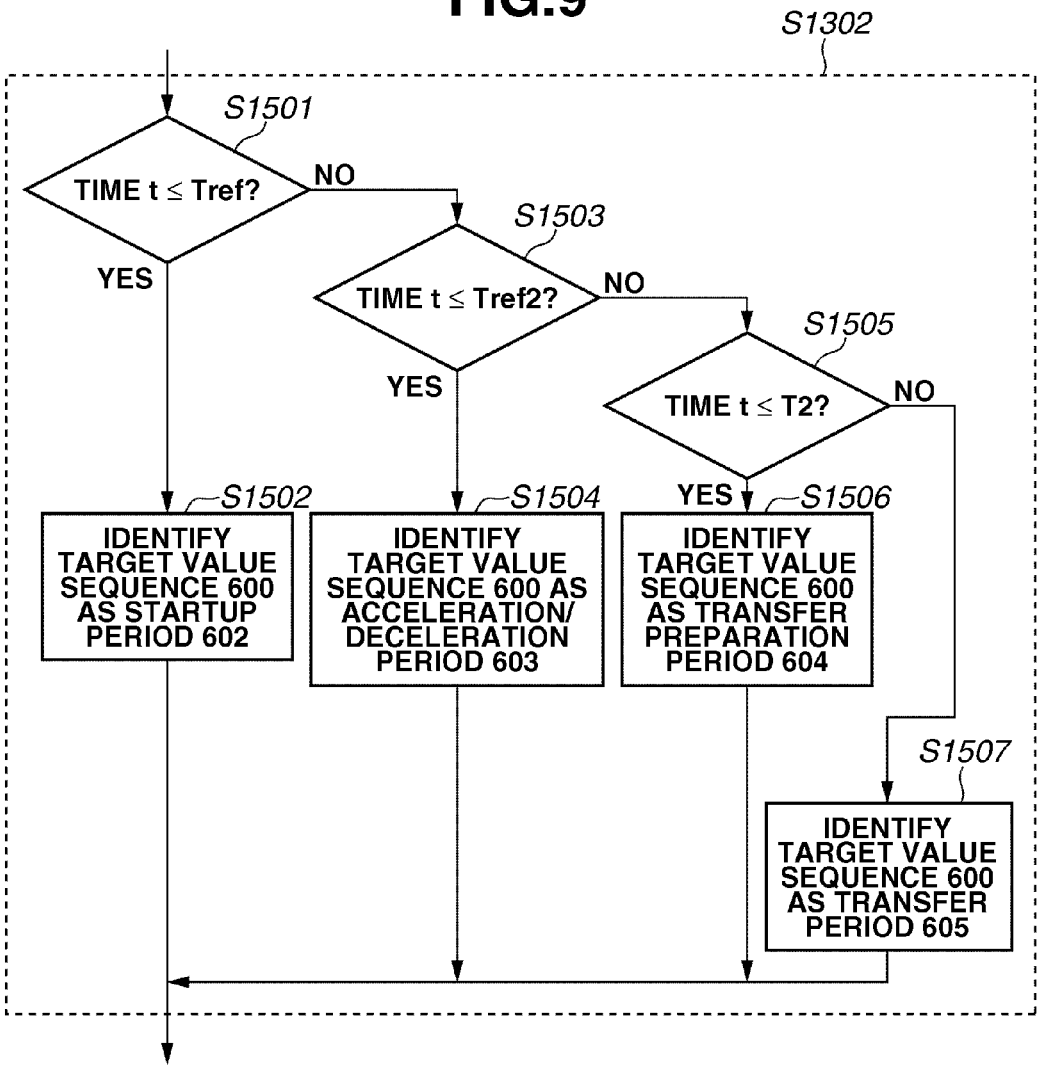
FIG. 9 is a flowchart illustrating a method for discriminating each control period in the process of conveying a recording material according to the first exemplary embodiment of the present invention.

An operation that can be performed by a control system configured to control the conveyance of the recording material P is schematically described below with reference to FIG. 8 and FIG. 9. FIG. 8 is a timing chart illustrating a conveyance state of the recording material P. FIG. 9 is a flowchart illustrating an example method for discriminating respective control periods in the process of conveying the recording material P. Hereinafter, the example operation that can be performed by the control system is described below with reference to the timing chart illustrated in FIG. 8 and the flowchart illustrated in FIG. 9. A target value sequence 600 indicates an example change of the speed target value SVvel 409 that can be generated by the conveyance sequence generation unit 404 while the time elapses. The target value sequence 600 includes four control periods divided based on operation characteristics of the target value sequence 600. The first control period is a startup period 602 during which the speed of the conveyance motor 202 is increased from a stop state until it reaches a predetermined speed. The second control period is an acceleration/deceleration period 603 during which the recording material P is accelerated or decelerated. The third control period is a transfer preparation period 604 during which the recording material P is conveyed to the transfer position at the image formation speed Vdr and at predetermined timing. The fourth control period is a transfer period 605 during which the recording material P is continuously conveyed at the image formation speed Vdr after the conveyed recording material P has reached the transfer position. The above-described four control periods are segmented according to the elapsed time, as described below.

In FIG. 8, control start timing 601 is the timing the conveyance sequence generation unit 404 starts generating the speed target value SVvel 409 in response to a print instruction received from a controller (not illustrated). The recording material conveyance start timing 501 comes after time T0 has elapsed since the control start timing 601. In the following description, the "elapsed time" is the period of time starting from the recording material conveyance start timing 501. In step S1501, the conveyance sequence generation unit 404 determines whether the time t1 is equal to or less than the predetermined elapsed time Tref. If the time t1 is equal to or less than predetermined elapsed time Tref (YES in step S1501), then in step S1502, the conveyance sequence generation unit 404 identifies the target value sequence 600 as the startup period 602. If the time t1 is greater than the time Tref (NO in step S1501) and is equal to or less than predetermined elapsed time Tref2 (YES in step S1503), then in step S1504, the conveyance sequence generation unit 404 identifies the target value sequence 600 as the acceleration/deceleration period 603. If the time t1 is greater than the time Tref2 (NO in step S1503) and is equal to or less than predetermined time T2 (YES in step S1505), then in step S1506, the conveyance sequence generation unit 404 identifies the target value sequence 600 as the transfer preparation period 604. If the time t1 is greater than the time T2 (NO in step S1505), then in step S1507, the conveyance sequence generation unit 404 identifies the target value sequence 600 as the transfer period 605. In the present exemplary embodiment, as illustrated in FIG. 3, the time Tref is the ideal time when the ideal leading edge position of the recording material is detected by the registration sensor 313. Further, as illustrated in FIG. 3, the time T1 is the time when the actual leading edge position of the recording material P is detected by the registration sensor 313. Further, as illustrated in FIG. 3, the time T2 is the time when the ideal leading edge position of the recording material P reaches the transfer position. The time Tref2 can be expressed using the following formula (6).

$$Tfref2 = T1\max + Tacc \quad (6)$$

In the formula (6), T1max represents a predicted maximum delay time of T1, and Tacc represents a period of time during which the conveyance sequence generation unit 404 outputs the speed target value SVvel 409 to perform an acceleration/deceleration operation taking the positional correction amount into consideration.

The conveyance sequence generation unit 404 sends the conveyance sequence period information 412 including the present period to the control constant changing unit 406 and the control section selecting unit 407, based on the elapsed time. The definition defining the elapsed time is not limited to the above-described example. An arbitrary value can be employed. An example relationship between the conveyance sequence period information 412 and the control constant combination information 416 is described in detail below. Further, an example relationship between the conveyance sequence period information 412 and the control unit combination information 414 is described in detail below.

Figure 10:
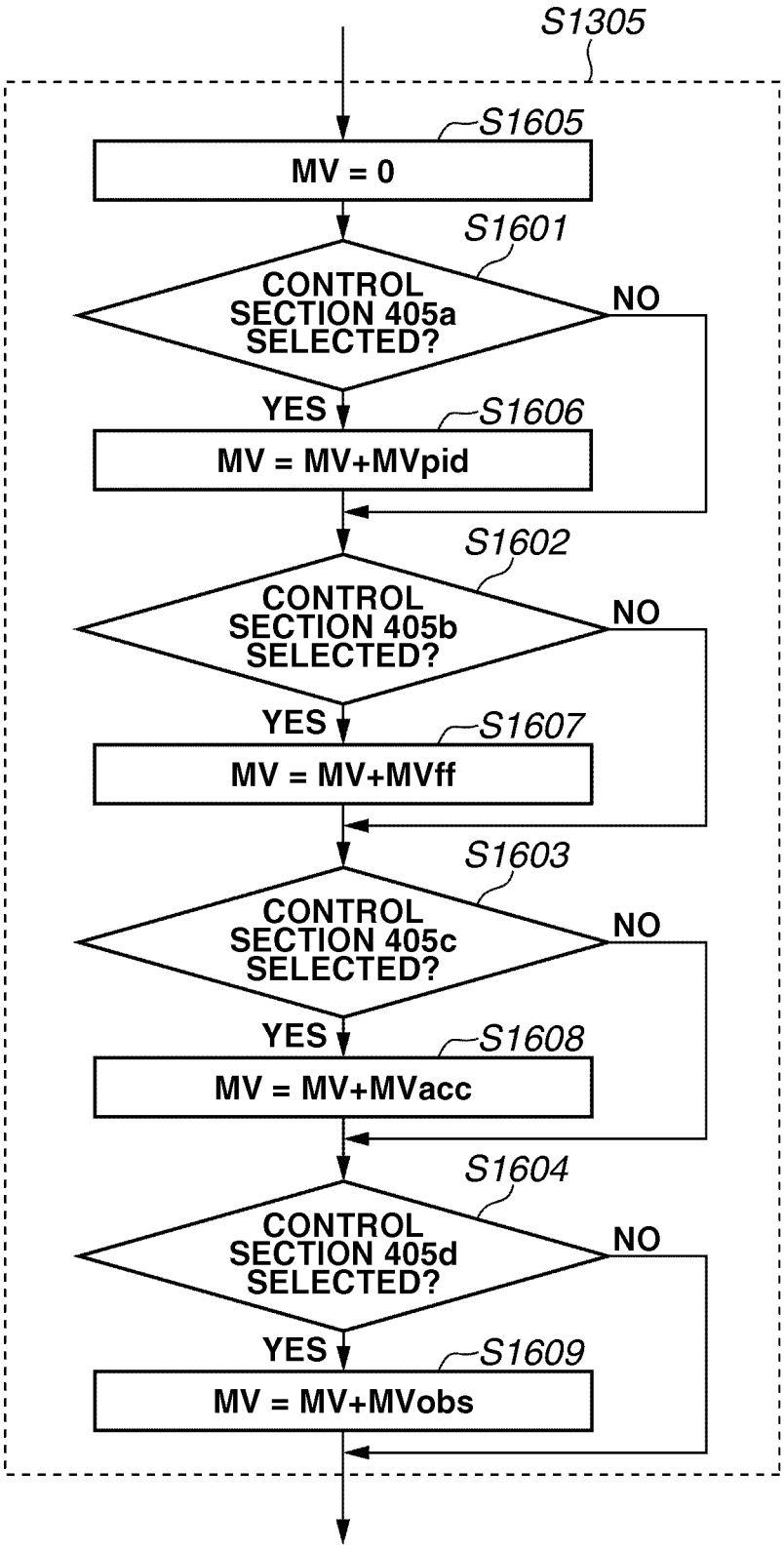
FIG. 10 is a flowchart schematically illustrating an operation that can be performed by a control section selecting unit according to the first exemplary embodiment of the present invention.

FIG. 10 is a flowchart schematically illustrating an operation that can be performed by the control section selecting unit 407. Hereinafter, an example operation that can be performed by the control section selecting unit 407 is described with reference to the timing chart illustrated in FIG. 8 and the flowchart illustrated in FIG. 10. Control information based on the combination of the control sections 405*a* to 405*d*, in the control periods notified by the conveyance sequence period information 412, is stored in the control section combination information 414. The conveyance sequence period information 412 and the combination of the control sections 405*a* to 405*d* to be selected are described below in detail.

In the startup period 602, the control section selecting unit 407 selects the control section 405*a* and 405*b*. In the acceleration/deceleration period 603, the control section selecting unit 407 selects the control sections 405*a*, 405*b*, and 405*c*. In the transfer preparation period 604, the control section selecting unit 407 selects the control sections 405*a*, 405*b*, and 405*d*. In the transfer period 605, the control section selecting unit 407 selects the control sections 405*a*, 405*b*, and 405*c*. In steps S1601 to S1604, the control section selecting unit 407 determines a combination of the control sections 405*a* to 405*d* to be selected based on the relationship between the conveyance sequence period information 412 and the control section combination information 414. In steps S1605 to S1609, the control section selecting unit 407 calculates the motor manipulated variable MV 413 by adding only the manipulated variables of the selected control sections. For example, in the startup period 602, if it is determined that the control section 405*a* is selected (YES in step S1601), then in step S1606, the control section selecting unit 407 calculates the motor manipulated variable MV 413 using a formula MV=MV+MVpid. Values of the control constants 417 to 422 in the control periods notified by the conveyance sequence period information 412 are stored in the control constant combination information 416, although numerical values of the control constants 417 to 422 are not described in detail.

FIG. 11 is a graph illustrating an example relationship between the conveyance sequence period information 412 and the control constant combination information 416 and an example relationship between the conveyance sequence period information 412 and the control section combination information 414. In respective control periods notified by the conveyance sequence period information 412, control constant value characteristics are described in the field of respective control sections to be selected and "x" is described in the field of each non-selected control section. The setting of the control constants and the control section to be selected is a mere example and is not limited to a specific example described in the present exemplary embodiment. For example, the startup period 602 can be segmented into two periods, such as a startup period 602*a* and a constant speed period 602*b*, to precisely perform the conveyance control for the recording material P. Example control in each control period is described below with reference to FIG. 11.

The control in the startup period 602 includes increasing the speed target value SVvel 409 and starting driving the conveyance motor 202 from the stop state. The control in the startup period 602 further includes increasing the angular speed of the conveyance motor 202 until the circumferential speed of the conveyance rollers 311 reaches the image formation speed Vdr. The control further includes starting the conveyance of the recording material P. The control further includes performing control for causing the recording material P to pass through the registration sensor 313 at the image formation speed Vdr. Accordingly, the conveyance motor 202 is required to promptly reach the conveyance speed Vp after the control starts at the timing 601 and maintain the reached conveyance speed. The conveyance speed Vp is the angular speed of the conveyance motor 202, at which the circumferential speed of the conveyance rollers 311 becomes equal to the image formation speed Vdr.

Further, the deviation "e" 706 between the position target value SV 704 and the position control amount PV 705 is mainly variable depending on the speed target value SVvel 409. Accordingly, it is desired that the paper feed and conveyance control unit 401 has control characteristics excellent in target value responsiveness. In the startup period 602, the control section selecting unit 407 selects the control section 405*a* that can realize the follow-up control to follow the position target value SV 704 and the control section 405*b* that can enhance target response characteristics (see step S1601, S1606, S1602, and S1607). The startup period 602 is characteristic in that a large acceleration operation is performed in a short period of time. If the control section 405*c* is selected, the manipulated variable MV 413 becomes steep and the angular speed of the conveyance motor 202 may become vibratory. Therefore, the control section selecting unit 407 does not select the control section 405*c* (see step S1603). However, if the change of the speed target value SVvel 409 in the startup period 602 is sufficiently small, or in a case where the angular speed of the conveyance motor 202 becomes vibratory without exceeding a predetermined range, the control section selecting unit 407 can select the control section 405*c*. Further, the control section selecting unit 407 does not select the control section 405*d* because a large overshoot ay occur if the control section 405*d* is selected (see step S1604). However, if the control constant Wobs 422 is sufficiently small, or in a case where the overshoot does not exceed a predetermined range, the control section selecting unit 407 can select the control section 405*d*.

The control constant changing unit 406 sets the control constant Kp 417, the control constant Ki 418, and the control constant Kd 419 of the control section 405*a* in such a way as to become excellent in target value responsiveness (see step S1303). The value setting for the control constant Kp 417, the control constant Ki 418, and the control constant Kd 419 is not limited to the above-described example. Any setting of the control constants is employable if it can enhance the target value responsiveness. Performing the above-described control is effective in suppressing the overshoot that may occur when the angular speed of the conveyance motor 202 reaches the conveyance speed Vp. Further, the time required for the angular speed of the conveyance motor 202 to converge on the conveyance speed Vp can be reduced. Thus, the above-described control in the startup period 602 can reduce the time required to start the conveyance of the recording material P.

The control in the acceleration/deceleration period 603 includes detecting the leading edge position of the conveyed recording material P by the registration sensor 313 and performing acceleration/deceleration control taking a positional correction amount into consideration to correct a deviation amount in such away as to adjust the position of the recording material P in synchronization with an image formed on the photosensitive drum 301. In the acceleration/deceleration period 603, it is desired that the deviation "e" 706 is zero or small at the end of the acceleration/deceleration period 603. Further, if the speed control amount PVvel 410 is vibratory, the recording material P may slip relative to the conveyance rollers 311. There is some possibility of losing the matching between the actual leading edge position of the recording material P and the position control amount PV 705. Further, it is desired that the speed control amount PVvel 410 is not vibratory. Alternatively, it is desired that the amplitude of the vibration is small or the frequency of the vibration is low. Accordingly, similar to the startup period 602, it is desired that the paper feed and conveyance control unit 401 has control characteristics excellent in target value responsiveness. Accordingly, in the acceleration/deceleration period 603, the control section selecting unit 407 selects the control section 405*a* that can realize the follow-up control to follow the speed target value SVvel 409, the control section 405*b* that can enhance target response characteristics, and the control section 405*c* that can enhance target response characteristics for an acceleration/deceleration operation (see steps S1601 to S1603, and S1606 to S1608). The control section 405*a* performs feedback control. Therefore, the responsiveness is dependent on the interval of encoders or the pulse width of a frequency generation (FG) pulse. The responsiveness cannot be improved even if the number of times of sampling is increased beyond the interval of the encoders or the pulse width of the FG pulse.

On the other hand, the control section 405*c* performs feed-forward control. Therefore, the responsiveness can be increased if the number of samplings becomes larger. More specifically, if the feed-forward control is added, the control can be performed in such a way as to reduce the deviation by the feed-forward control before correcting the deviation by the feedback control. More specifically, it is feasible to improve the response to the deviation by combining the feed-forward control and the feedback control in such a way as to reduce the deviation, compared to a case where only the feedback control is performed. The control section selecting unit 407 does not select the control section 405*d* because the overshoot tends to become large (see step S1604). However, if the control constant Wobs 422 is sufficiently small, or in a case where the overshoot does not exceed a predetermined range, the control section selecting unit 407 can select the control section 405*d*. Further, similar to the startup period 602, the control constant changing unit 406 sets the control constant Kp 417, the control constant Ki 418, and the control constant Kd 419 of the control section 405*a* in such a way as to become excellent in target value responsiveness (see step S1303). The value setting for the control constant Kp 417, the control constant Ki 418, and the control constant Kd 419 can be performed in the same manner as the above-described setting for these constant values in the startup period 602. Any setting of the control constants is employable if it can enhance the target value responsiveness. Performing the above-described control is effective in correcting a delay or an advance of the leading edge position of the recording material P while maintaining the matching between the leading edge position of the recording material P and the position control amount PV 705.

The control in the transfer preparation period 604 includes conveying the recording material P to the transfer position at the image formation speed Vdr. It is required that the leading edge of the recording material P reaches the transfer position at the desired timing (T2). In the transfer preparation period 604, the speed target value SVvel 409 is a constant value and the deviation "e" 706 between the position target value SV 704 and the position control amount PV 705 is mainly dependent on a disturbance. Accordingly, in the transfer preparation period 604, it is desired that the paper feed and conveyance control unit 401 has control characteristics excellent in disturbance suppressibility. The above-described control in the acceleration/deceleration period 603 prioritizes the target value responsiveness to suppress the variation of the speed target value SVvel 409. However, in the transfer preparation period 604, the speed target value SVvel is constant. Accordingly, even if the control is performed in such a way as to prioritize the disturbance suppressibility, which is in a trade-off relationship with the target value responsiveness, there will be no tendency toward vibratory control. Hence, in the transfer preparation period 604, the control section selecting unit 407 selects the control section 405*a* that can realize the follow-up control to follow the position target value SV 704, the control section 405*b* that can enhance target response characteristics, and the control section 405*d* that can enhance the disturbance suppressibility (see steps S1601 to S1604, S1606, S1607, and S1609).

The control constant changing unit 406 changes the control constant Kp 417, the control constant Ki 418, and the control constant Kd 419 of the control section 405*a* in such a way as to prioritize the disturbance suppressibility over the target value responsiveness. To this end, for example, the control constant changing unit 406 sets the control constant Kp 417 to have a large value compared to the setting value in the startup period 602. The value setting for the control constant Kp 417, the control constant Ki 418, and the control constant Kd 419 is not limited to the above-described example. Any setting of the control constants is employable if it can enhance the disturbance suppressibility. Further, the control constant changing unit 406 sets the control constant Wobs 422 of the control section 405*d* in such a way as to have a value capable of suppressing high-frequency disturbance. In the transfer preparation period 604, ensuring the timing the recording material P arrives at the transfer position is prioritized over maintaining the conveyance speed. Setting a higher value for the control constant Wobs 422 is effective to compensate a steep disturbance torque although the angular speed of the conveyance motor 202 tends to vibrate. Accordingly, in the transfer preparation period 604, the control constant changing unit 406 sets a higher value for the control constant Wobs 422 (see step S1303). Performing the above-described control is effective in promptly correcting a delay or an advance of the leading edge position that may be caused by a disturbance while maintaining the matching between the leading edge position of the recording material P and the position control amount PV 705. Accordingly, the control can be performed in such a way as to cause the recording material P to accurately arrive at the transfer position.

The transfer period 605 is a control period in which the recording material P has already arrived at the transfer position. It is required to convey the recording material P at the image formation speed Vdr. Further, in the transfer period 605, the photosensitive drum 301 and the transfer roller 310, which are operated by a driving unit different from the conveyance motor 202, convey the recording material P at the image formation speed Vdr. Therefore, the conveyance motor 202 is required to equalize the conveyance speed Vp with the speed target value SVvel 409 and eliminate any abrupt speed variation that may induce push or pull relative to the transfer position. Therefore, it is desired to employ control that moderately responds to the deviation "e" 706 while preventing the deviation "e" 706 from occurring due to a disturbance. Accordingly, in the transfer period 605, the control section selecting unit 407 selects the control section 405*a* that can realize the follow-up control to follow the position target value SV 704, the control section 405*b* that can enhance the target value responsiveness, and the control section 405*d* that can enhance the disturbance suppressibility (see steps S1601 to S1604, S1606, S1607, and S1609).

The control constant changing unit 406 changes the control constant Kp 417, the control constant Ki 418, and the control constant Kd 419 of the control section 405*a* in such a way as to prioritize the moderate target value responsiveness over the disturbance suppressibility. To this end, for example, the control constant changing unit 406 sets the control constant Kp 417 to have a smaller value compared to the setting value in the startup period 602. The value setting for the control constant Kp 417, the control constant Ki 418, and the control constant Kd 419 is not limited to the above-described example. Any setting of the control constants is employable if it can enhance the moderate target value responsiveness. Further, the control constant changing unit 406 sets the control constant Wobs 422 of the control section 405*d* in such a way as to have a value lower than the value having been set in the transfer preparation period 604 (see step S1303). According to the method illustrated in FIG. 10, in step S1605, the control section selecting unit 407 sets a numerical value "0" for the manipulated variable MV 413. Alternatively, if it is desired, the control section selecting unit 407 can set a predetermined offset value. Performing the above-described control is effective in eliminating an abrupt speed change even if the conveyance speed Vp of the recording material P is changed. Therefore, it is feasible to moderately convey the recording material P as a result of suppressing the change in the conveyance speed Vp. Accordingly, the push or pull of the recording material P relative to the transfer position can be reduced.

As described above, the operation according to the exemplary embodiment includes selecting an optimum combination of control sections that is suitable for each control period in the process of conveying the recording material P. The operation further includes setting suitable control constants to perform the follow-up control in respective control periods. Compared to a case where the conveyance motor is constantly controlled by fixed control sections with uniform control constants, the operation according to the present exemplary embodiment can realize excellent control performances. For example, even in a case where a driving source is a DC motor or a comparable motor that requires feedback control, the operation according to the present exemplary embodiment can prevent deterioration in followability when acceleration/deceleration control is performed on the conveyance speed of a recording material.

As described above, the monochrome printer is a mere example to which the conveyance control according to the present exemplary embodiment is applicable. The conveyance control according to the present exemplary embodiment is also applied to a color printer or an inkjet printer. Further, a method for appropriately selecting control sections in respective control periods in the process of conveying a recording material from the paper feeding cassette to the transfer position in an image forming apparatus is not limited to the above-described example. For example, the method according to the present exemplary embodiment can be similarly applied to a recording material reading apparatus that is configured to read an image formed on the surface of a recording material, in which a recording material conveyance period is regarded as comparable to the above-described acceleration/deceleration period 603 and a recording material reading period is regarded as comparable to the above-described transfer period 605. As described above, the operation according to the present exemplary embodiment can select an optimum combination of control sections in each recording material conveyance period, not only for the image forming apparatus but also for any other apparatus configured to convey a recording material. For example, even in a case where a driving source is a DC motor or a comparable motor that requires feedback control, the operation according to the present exemplary embodiment can prevent deterioration in followability when acceleration/deceleration control is performed on the conveyance speed of a recording material.

The operation described in the first exemplary embodiment includes selecting an optimum combination of control sections that is suitable for each control period in the process of conveying the recording material P and performing the follow-up control suitable for respective control periods. In an operation according to a second exemplary embodiment, a variation in load torque due to the difference in type of each recording material P is taken into consideration. In the following description, constituent components similar to those described in the first exemplary embodiment are denoted by the same reference numerals and the descriptions thereof are not repeated.

Figure 12:
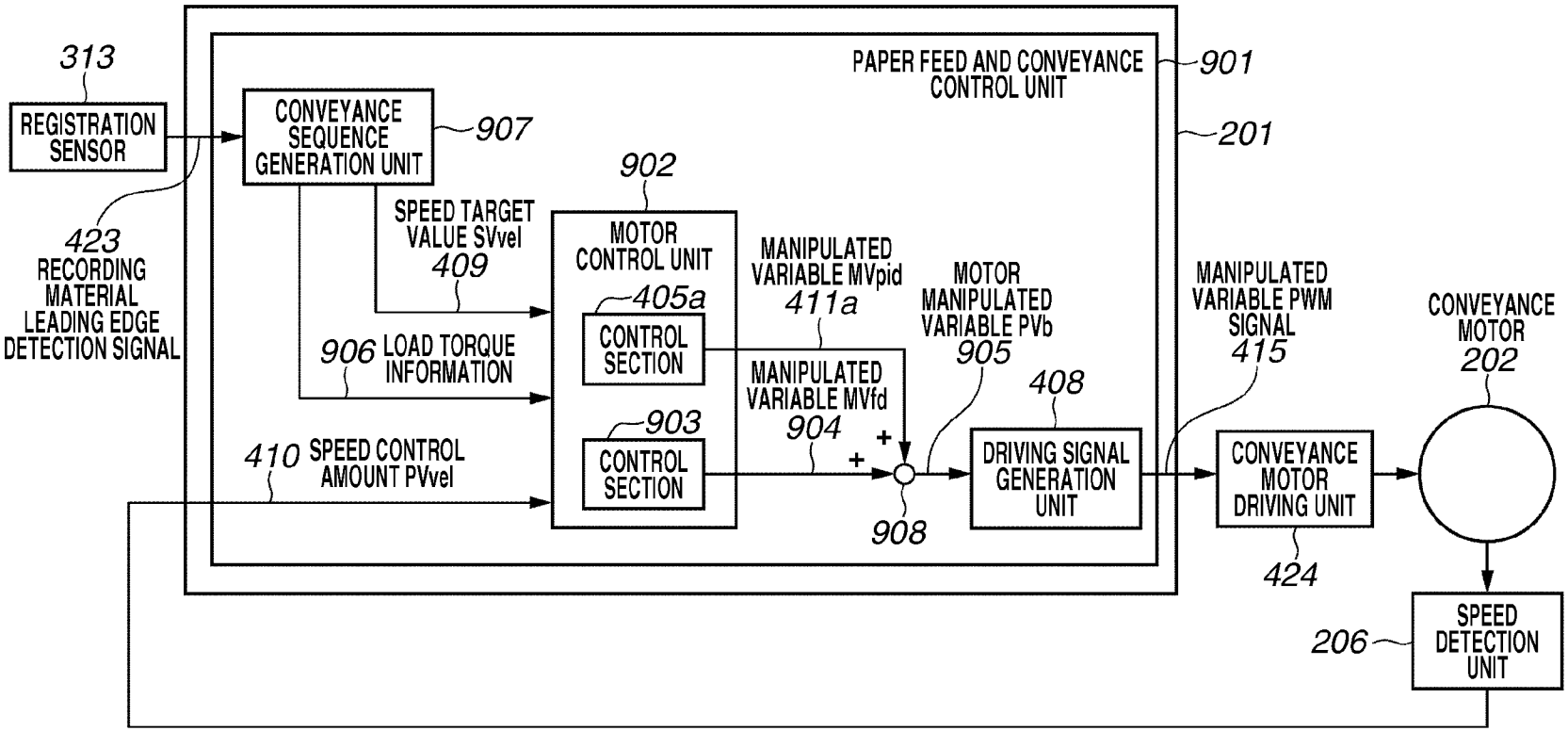
FIG. 12 is a functional block diagram illustrating a paper feed and conveyance control unit according to a second exemplary embodiment of the present invention.

FIG. 12 is a functional block diagram schematically illustrating a paper feed and conveyance control unit 901. The paper feed and conveyance control unit 901 can receive a speed control amount PVvel 410 and a recording material leading edge detection signal 423. The paper feed and conveyance control unit 901 can output a manipulated variable PWM signal 415 based on the input signals. The paper feed and conveyance control unit 901 includes a conveyance sequence generation unit 907, a motor control unit 902, an addition device 908, and a driving signal generation unit 408. The conveyance sequence generation unit 907 can receive the recording material leading edge detection signal 423 and can output a speed target value SVvel 409 and load torque information 906. The speed target value SVvel 409 is a target angular speed of the conveyance motor 202. When a registration sensor 313 detects the leading edge of the recording material P, the registration sensor 313 sends the recording material leading edge detection signal 423 to the conveyance sequence generation unit 907.

The conveyance sequence generation unit 907 calculates a deviation amount between the position of an image already formed on the photosensitive drum 301 and the position of the currently conveyed recording material P based on the recording material leading edge detection signal 423. Then, to correct the position of the recording material P with reference to the position of the image formed on the photosensitive drum 301, the conveyance sequence generation unit 907 sends the speed target value SVvel 409 to the motor control unit 902, taking the positional correction amount into consideration to correct the deviation amount. Then, to correct the position of the recording material P with reference to the position of the image formed on the photosensitive drum 301, the conveyance sequence generation unit 907 increases or decreases the speed target value SVvel 409. Further, the conveyance sequence generation unit 907 sends the load torque information 906 to the motor control unit 902. The load torque information 906 is described in detail below. The motor control unit 902 receives the speed target value SVvel 409, the load torque information 906, and the speed control amount PVvel 410. The motor control unit 902 outputs a manipulated variable MVpid 411*a* and a manipulated variable MVfd 904. The addition device 908 adds the manipulated variable MVpid 411*a* and the manipulated variable MVfd 904 to generate a motor manipulated variable PVb 905.

Figure 13:
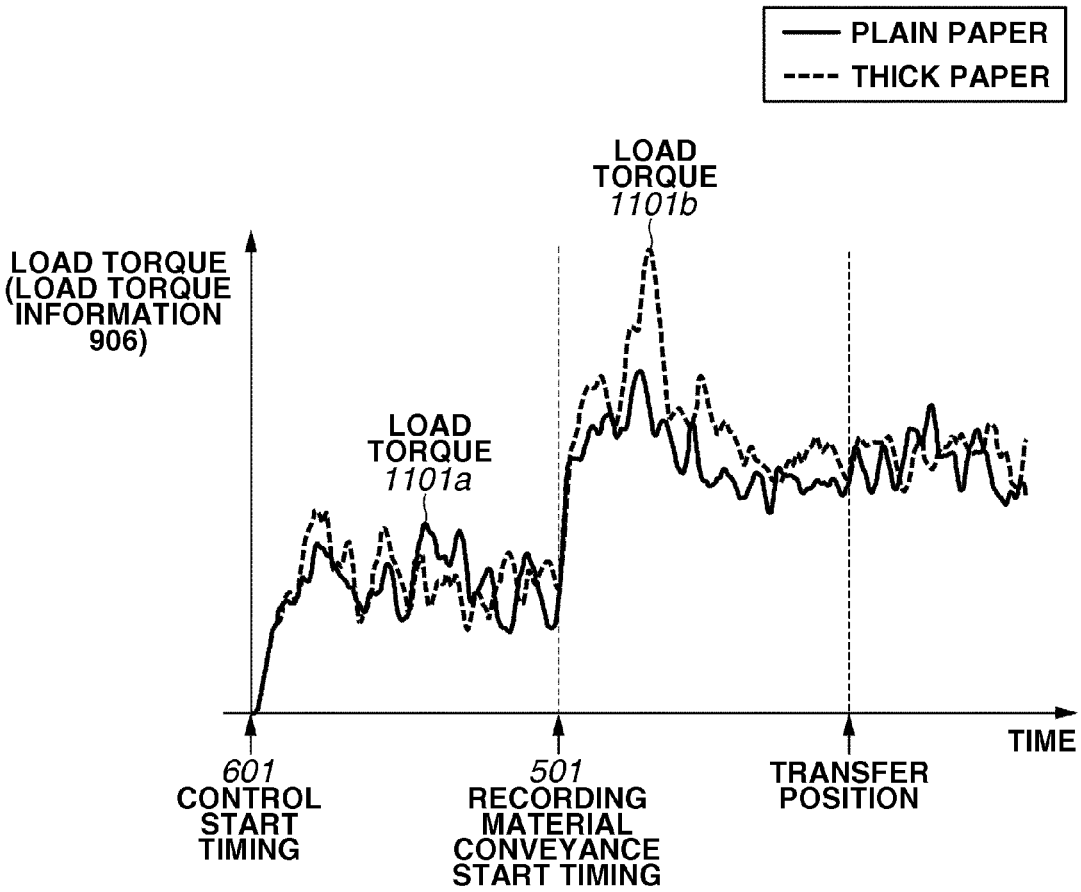
FIG. 13 is a graph illustrating load torque information that can be output by a conveyance sequence generation unit.

The load torque information 906 that can be generated by the conveyance sequence generation unit 907 is described below with reference to FIG. 13, in which the abscissa axis represents the elapsed time and the ordinate axis represents the load torque applied to the conveyance motor 202 in the process of conveying the recording material P. In FIG. 13, a solid line indicates a load torque 1101*a* applied to the conveyance motor 202 when the recording material P is plain paper and a dotted line indicates a load torque 1101*b* applied to the conveyance motor 202 when the recording material P is thick paper. In the present exemplary embodiment, the grammage of the plain paper (one recording material) is 75 g/m$^2$ and the grammage of the thick paper (the other recording material) is 120 g/m$^2$. The load torques 1101*a* and 1101*b* are measured beforehand and stored in the conveyance sequence generation unit 907. Further, the load torque 1101*a* is output from the conveyance sequence generation unit 907 as the load torque information 906 if the conveyed recording material P is plain paper and the load torque 1101*b* is output if the conveyed recording material P is thick paper. For example, a user can designate the type of the recording material P to be conveyed (hereinafter, the type of the recording material P may be referred to as "paper type"). A notification including the designated paper type can be transmitted to the conveyance sequence generation unit 907. Further, it is useful to additionally provide a recording material detection unit, such as an optical or ultrasonic media sensor, to detect the type of the recording material P. The illustrated load torques 1101*a* and 1101*b* are mere examples. For example, it is useful to obtain averaged load torques based on repetitively performed measurements. It is also useful to obtain approximate load torques based on the measured load torques. It is also useful to predict load torques based on the structure of the conveyance path. Further, in the present exemplary embodiment, only two paper types are prepared to simplify the description. For example, the paper type can be classified more finely in such a way as to discriminate thin paper. However, the definition of the paper types is not limited to the above-described examples. Further, adaptively using the load torque information 906 is feasible by taking environmental conditions of the image forming apparatus, such as temperature or humidity, the conveyance speed of the recording material P, or deterioration of a conveyance member that conveys the recording material P into consideration.

Figure 14:
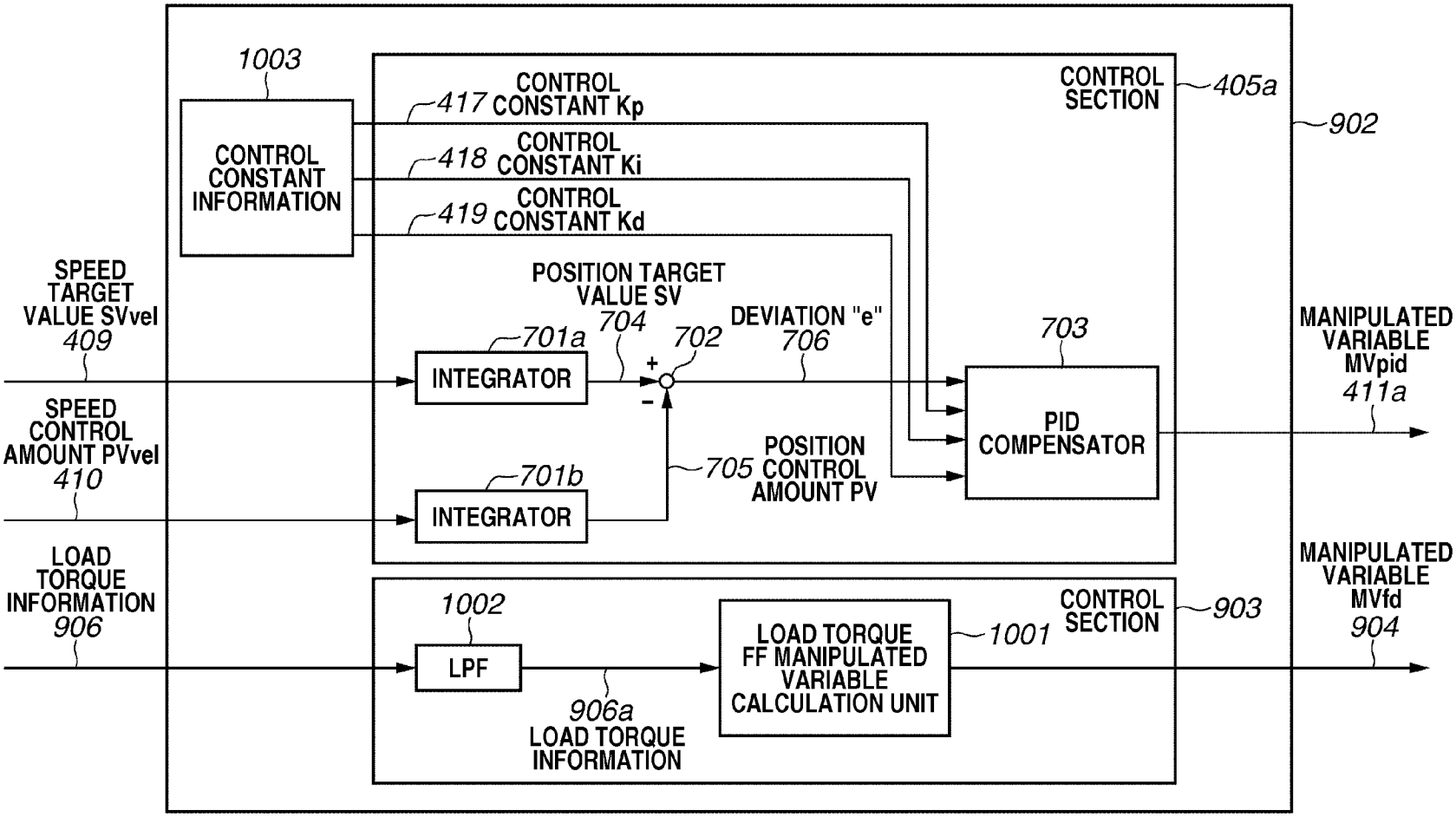
FIG. 14 is a functional block diagram illustrating a motor control unit according to the second exemplary embodiment of the present invention.

FIG. 14 is a functional block diagram schematically illustrating the motor control unit 902. The paper feed and conveyance control unit 901 includes a control section 405*a*, a control section 903, and control constant information 1003. The control constant information 1003 stores various values, such as control constant Kp 417, control constant Ki 418, and control constant Kd. The control constant information 1003 can be supplied to the control section 405*a*. Practical values of the control constants are not described in detail below.

The control section 903 can receive the load torque information 906 and can output the manipulated variable MVfd 904. The control section 903 includes a low-pass filter (referred to as "LPF") 1002 that can perform filter processing on the load torque information 906 to generate load torque information 906*a*. The control section 903 further includes a load torque FF manipulated variable calculation unit 1001 that can generate a voltage value compensating the load torque information 906*a* and can output the generated voltage value as the manipulated variable MVfd 904. A transfer function Gτ(s) of the load torque FF manipulated variable calculation unit 1001 can be expressed using the following formula (7) based on the conveyance motor approximate model. The manipulated variable MVfd can be expressed using the following formula (8). In the present exemplary embodiment, Kt represents a torque constant of the conveyance motor 202 and L represents an internal inductance of the conveyance motor 202. Further, R represents a winding resistance of the conveyance motor 202. Kt, L, and R values are stored in the control section 903.

$$G\tau(s) = \frac{L \times s + R}{Kt} \tag{7}$$

$$MV\,fd = G\tau(s) \cdot (\text{load torque information } 906a) \tag{8}$$

The motor control unit 902 outputs the manipulated variable MVfd 904 to predict and compensate a load torque to be applied to the conveyance motor 202. Accordingly, it becomes feasible to reduce the influence of a load torque received by the conveyance motor 202. If the load torque information 906 does not include any high-frequency component, the control section 903 can be configured to calculate the manipulated variable MVfd 904 without using the LPF 1002.

As described above, the operation according to the present exemplary embodiment includes measuring a load torque applied to the conveyance motor 202 in the process of conveying the recording material P for each type of the recording material P and storing a measurement result in the control section. The operation further includes calculating a manipulated variable in such a way as to cancel the measured load torque according to the type of the conveyed recording material P, and adding the calculated manipulated variable to the motor manipulated variable. More specifically, the operation according to the present exemplary embodiment can predict and compensate the load torque to be applied to the conveyance motor 202 in the process of conveying the recording material P. Accordingly, in the conveyance motor control, the operation according to the present exemplary embodiment can reduce the influence of the load torque applied to the conveyance motor in a paper feed and conveyance operation.

The operation described in the first exemplary embodiment includes selecting an optimum combination of control sections that is suitable for each control period in the process of conveying the recording material P and performing the follow-up control suitable for respective control periods. An operation according to a third exemplary embodiment is performed based on a method using the elapsed time and the recording material leading edge detection signal 423 in the control period of the target value sequence 600. In the following description, constituent components similar to those described in the first exemplary embodiment are denoted by the same reference numerals and the descriptions thereof are not repeated.

Figure 15:
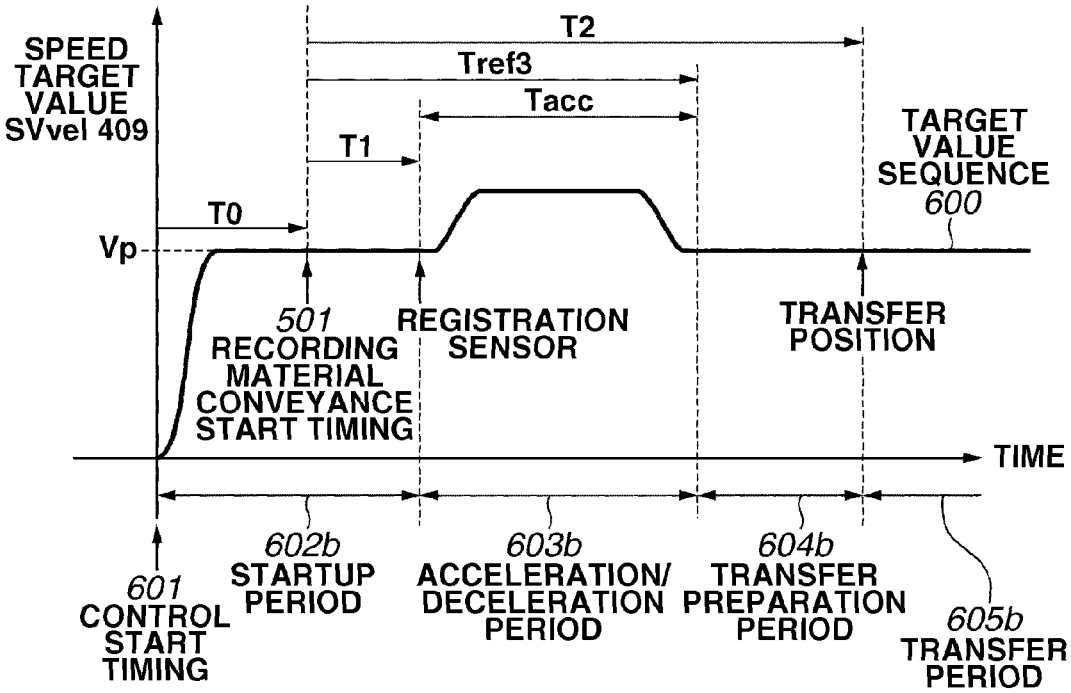
FIG. 15 is a timing chart illustrating a conveyance state of a recording material.

FIG. 15 is a timing chart illustrating a conveyance state of the recording material P. The paper feed and conveyance control unit 401 according to the present exemplary embodiment detects the leading edge of the recording material P based on a signal received from the registration sensor 313 and then performs acceleration/deceleration control for the conveyance motor 202. More specifically, the recording material leading edge detection signal 423 notifying the detection of the leading edge of the recording material P is a notification indicating a change point in the operation characteristics of the target value sequence 600. Accordingly, when the recording material leading edge detection signal 423 (i.e., the output of the registration sensor 313) is used in segmenting the target value sequence 600, it is feasible to accurately segment the target value sequence 600 at the change point of the operation characteristics. The operation according to the present exemplary embodiment includes segmenting the target value sequence 600 into four control periods and performing different control operations in respective control periods. The segmentation of the target value sequence 600 can be performed based on the operation characteristics. The elapsed time and the recording material leading edge detection signal 423 (i.e., an input signal from the registration sensor 313) are usable in segmenting the target value sequence 600 into a plurality of control periods.

The target value sequence 600 includes four control periods divided based on the operation characteristics. The first control period is a startup period 602*b* starting from the control start timing 601 and ending at the elapsed time T1 (i.e., the timing the leading edge of the recording material P is detected). The second control period is an acceleration/deceleration period 603*b* starting from the elapsed time T1 and ending at elapsed time Tref3. The third control period is a transfer preparation period 604*b* starting from the elapsed time Tref3 and ending at the elapsed time T2. The fourth control period is a transfer period 605*b* starting from the elapsed time T2. Further, the elapsed time Tref3 can be expressed using the following formula (9).

$$Tref3 = T1 + Tacc \tag{9}$$

The conveyance control of the recording material P to be performed in respective control periods is similar to the control described in the first exemplary embodiment and, therefore, its description is not repeated.

As described above, the control period can be accurately segmented by defining control periods with reference to change points of the operation characteristics, rather than segmenting the conveyance sequence depending on only the elapsed time. Therefore, the operation according to the above-described exemplary embodiment can improve the accuracy in the conveyance control of the recording material P.

In the first exemplary embodiment, a combination of control sections selected as illustrated in FIG. 11 realizes the control for respective control periods. An operation according to a fourth exemplary embodiment includes allocating a weighting coefficient to each calculation formula for obtaining a manipulated variable of each control section and changing the coefficient for each control period, as described below. Constituent components similar to those described in the first exemplary embodiment are denoted by the same reference numerals and their descriptions are not repeated.

In the present exemplary embodiment, the manipulated variable MVpid 411*a* can be calculated by multiplying the formula (1) by a weighting coefficient Kpid, according to the following formula (10).

$$MVpid = Kpid \times \left(Kp + \frac{Ki}{s} + Kd \times s\right) \times E \tag{10}$$

Further, the manipulated variable MVobs 411*d* can be calculated by multiplying the formula (5) by a weighting coefficient Kobs, according to the following formula (11).

$$MVobs = Kobs \times \left(\frac{Wobs}{s + Wobs} \times \frac{1}{L \times s + R} \times MV - \frac{Wobs}{1 + \frac{Wobs}{s}} \times \frac{J}{Kt} \times PVvel\right) \tag{11}$$

In the present exemplary embodiment, weighting coefficients of the control section 405*a*, the control section 405*b*, the control section 405*c*, and the control section 405*d* are variable in all control periods (i.e., the startup period 602, the acceleration/deceleration period 603, the transfer preparation period 604, and the transfer period 605) to realize the setting of the control sections according to respective control periods, as described in the above-described first exemplary embodiment.

In the startup period 602, the operation according to the present exemplary embodiment sets 0 or a sufficiently small value as a value for the control constant Ka of the control section 405*c* and sets 0 or a sufficiently small value as a value for the control constant Kobs of the control section 405*d*. In the acceleration/deceleration period 603, the operation according to the present exemplary embodiment sets 0 or a sufficiently small value as a value for the control constant Kobs of the control section 405*d*. In the transfer preparation period 604 and the transfer period 605, the operation according to the present exemplary embodiment does not select the control section 405*c*. As the target value is constant, the control section 405*c* becomes 0 irrespective of designation of a value for the control constant Ka. Accordingly, it is unnecessary to designate any weighting coefficient in the transfer preparation period 604 and the transfer period 605. In the present exemplary embodiment, the manipulated variable selection unit 407 can be configured to output the motor manipulated variable MV 413 by adding all manipulated variables generated from respective control sections 405*a* to 405*d*.

As described above, the operation according to the present exemplary embodiment includes variably controlling weighting coefficients of respective control sections to select a combination of control sections suitable for respective control periods in the process of conveying the recording material P and setting control constants to realize the follow-up control for respective control periods. Compared to a case where the conveyance motor is constantly controlled by fixed control sections with uniform control constants, the operation according to the present exemplary embodiment can realize excellent control performances. For example, even in a case where a driving source is a DC motor or a comparable motor that requires feedback control, the operation according to the present exemplary embodiment can prevent deterioration in followability when acceleration/deceleration control is performed on the conveyance speed of a recording material.

The operation described in the first exemplary embodiment includes calculating a manipulated variable of the feed-forward control unit. In a fifth exemplary embodiment, the manipulated variable of the feed-forward control unit is stored beforehand as a profile. Constituent components similar to those described in the first exemplary embodiment are denoted by the same reference numerals and their descriptions are not repeated.

The operation according to the present exemplary embodiment includes calculating profiles of the manipulated variable MVfv 411*b* and the manipulated variable MVfa 411*c* beforehand based on a profile of the speed target value SVvel 409 and storing the calculated profiles beforehand in a memory. Further, the operation according to the present exemplary embodiment includes outputting the manipulated variable MVfv 411*b* and the manipulated variable MVfa 411*c* based on profiles of the manipulated variable MVfv 411*b* and the manipulated variable MVfa 411*c* that correspond to the profile of the speed target value SVvel 409 that can be output from the conveyance sequence generation unit 404.

The operation according to the present exemplary embodiment includes calculating the profile of the manipulated variable MVfv 411*b* according to the formula (2) and calculating the profile of the manipulated variable MVfa 411*c* according to the formula (4). Arbitrary values are usable as values of the control constant Kv 420 and the control constant Ka 421 to be used in the calculation. It is useful to prepare a plurality of profiles that can be selectively used according to an operation state. For example, it is useful to use a plurality of different sets of the control constant Kv 420 and the control constant Ka 421 to calculate profiles and store the obtained plurality of profiles in a memory. In this case, it is feasible to select appropriate profiles of the manipulated variables to be used, for example, with reference to the type of a conveyed recording material P, the environmental conditions (e.g., temperature and humidity) surrounding an image forming apparatus, the conveyance speed of the recording material P, or deterioration of a conveyance member that conveys the recording material P.

As described above, according to the present exemplary embodiment, a preliminarily calculated manipulated variable of the feed-forward control unit is stored as a manipulated variable profile in a memory and the feed-forward control can be performed without successively calculating the manipulated variable of the feed-forward control unit.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-225106 filed Oct. 12, 2011, which is hereby incorporated by reference herein in its entirety.

What is claimed is:

1. An image forming apparatus comprising:

a conveyance unit configured to convey a recording material;

a driving unit configured to drive the conveyance unit;

a plurality of control units each configured to calculate a manipulated variable according to a deviation between a value related to a conveyance speed of the recording material and a value related to a target conveyance speed; and a selection unit configured to select at least one manipulated variable from among plural manipulated variables calculated by the plurality of control units, wherein in a case where a recording material is positioned in a first period, the recording material is conveyed according to a first combination of at least one manipulated variable selected by the selection unit, and in a case where a recording material is positioned in a second period that is different from the first period, the recording material is conveyed according to a second combination of at least one manipulated variable selected by the selection unit, wherein the first combination and second combination are different.

2. The image forming apparatus according to claim 1, further comprising:

an image forming unit configured to form an image; and a transfer unit configured to transfer the image formed by the image forming unit to the recording material, wherein one of the plurality of control units is a feedback control unit configured to perform feedback control, which is follow-up control for causing the value related to the conveyance speed of the recording material to follow the value related to the target conveyance speed, to calculate a manipulated variable, and in a case where the feedback control unit performs feedback control when the recording material is conveyed in a period in which the image is transferred by the transfer unit to the recording material to cause the value related to the conveyance speed of the recording material to follow the value related to the target conveyance speed, an overshoot becomes smaller than an overshoot in a case where the feedback control unit performs feedback control when the recording material is conveyed in a period prior to the period in which the image is transferred by the transfer unit to the recording material to cause the value related to the conveyance speed of the recording material to follow the value related to the target conveyance speed.

3. The image forming apparatus according to claim 1, further comprising:

an image forming unit configured to form an image; and a transfer unit configured to transfer the image formed by the image forming unit to the recording material, wherein one of the plurality of control units is a disturbance suppression control unit configured to perform disturbance suppression control by predicting a disturbance torque applied to the driving unit and calculating a manipulated variable for compensating the predicted disturbance torque, and in a case where the disturbance suppression control unit performs disturbance suppression control when the recording material is conveyed in a period in which the image is transferred by the transfer unit to the recording material, a calculated manipulated variable for compensating a predicted disturbance torque is able to reduce the deviation between the value related to the conveyance speed of the recording material and the value related to the target conveyance speed more than a calculated manipulated variable for compensating a predicted disturbance torque in a case where the disturbance suppression control unit performs disturbance suppression control when the recording material is conveyed in a period prior to the period in which the image is transferred by the transfer unit to the recording material does.

4. The image forming apparatus according to claim 1, further comprising:

an image forming unit configured to form an image; and a transfer unit configured to transfer the image formed by the image forming unit to the recording material, one of the plurality of control units is a feedforward control unit configured to perform feedforward control by estimating a reverse voltage generated in the driving unit and calculating a manipulated variable for compensating the estimated reverse voltage, and wherein the manipulated variable for compensating the estimated reverse voltage calculated by the feedforward control unit by performing feedforward control is able to reduce the deviation between the value related to the conveyance speed of the recording material and the value related to the target conveyance speed.

5. The image forming apparatus according to claim 1, further comprising an image forming unit configured to form an image;

a transfer unit configured to transfer the image formed by the image forming unit to the recording material; and a detection unit configured to detect the recording material conveyed by the conveyance unit, wherein one of the plurality of control units is an acceleration feedforward control unit configured to perform acceleration feedforward control by predicting a voltage required to cause the driving unit to accelerate or decelerate and calculating a manipulated variable for compensating the predicted voltage, and wherein the acceleration feedforward control unit accelerates or decelerates the conveyance speed of the recording material based on a difference between a detection time when the recording material is detected by the detection unit and a target arrival time, and the manipulated variable for compensating the estimated voltage calculated by performing acceleration feedforward control is able to reduce the deviation between the value related to the conveyance speed of the recording material and the value related to the target conveyance speed.

6. The image forming apparatus according to claim 1, further comprising:

a detection unit configured to detect the recording material conveyed by the conveyance unit;

wherein the period in which the recording material is conveyed is determined to be switched, in response to the detection unit detecting the recording material.

7. The image forming apparatus according to claim 1, wherein the period in which the recording material is conveyed is determined to be switched, in response to a predetermined time having elapsed since the recording material starts being conveyed.

8. The image forming apparatus according to claim 1, wherein the selection unit selects the manipulated variable used for driving the conveyance unit according to a period in which the recording material is conveyed, from among a plurality of periods in which the recording material is conveyed.

9. The image forming apparatus according to claim 8, wherein the plurality of periods includes a startup period in which a speed of the driving unit is increased to a predetermined speed, an acceleration/deceleration period in which the recording material is accelerated or decelerated, a transfer preparation period in which the recording material is conveyed to a transfer position at an image formation speed, and a transfer period in which the image is transferred to the recording material at the transfer position.

10. The image forming apparatus according to claim 1, wherein the plurality of control units includes a feedback control unit configured to perform feedback control, which is follow-up control for causing the value related to the conveyance speed of the recording material to follow the value related to the target conveyance speed, to calculate a manipulated variable, an acceleration feedforward control unit configured to perform acceleration feedforward control by predicting a voltage required to cause the driving unit to accelerate or decelerate and calculating a manipulated variable for compensating the predicted voltage, a feedforward control unit configured to perform feedforward control by estimating a reverse voltage generated in the driving unit and calculating a manipulated variable for compensating the estimated reverse voltage, and a disturbance suppression control unit configured to perform disturbance suppression control by predicting a disturbance torque applied to the driving unit and calculating a manipulated variable for compensating the predicted disturbance torque.

11. A recording material conveyance apparatus comprising:

a conveyance unit configured to convey a recording material;

a driving unit configured to drive the conveyance unit;

a plurality of control units each configured to calculate a manipulated variable according to a deviation between a value related to a conveyance speed of the recording material and a value related to a target conveyance speed; and a selection unit configured to select at least one manipulated variable from among plural manipulated variables calculated by the plurality of control units, wherein in a case where a recording material is positioned in a first period, the recording material is conveyed according to a first combination of at least one manipulated variable selected by the selection unit, and in a case where a recording material is positioned in a second period that is different from a first period, the recording material is conveyed according to a second combination of at least one manipulated variable selected by the selection unit, and wherein the first combination and second combination are different.

* * * * *